US006305262B1

(12) United States Patent
Watanabe

(10) Patent No.: US 6,305,262 B1
(45) Date of Patent: Oct. 23, 2001

(54) SHEET PUNCH DEVICE AND A SHEET PUNCH METHOD

(75) Inventor: Tetsuji Watanabe, Chiryu (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/359,708

(22) Filed: Jul. 23, 1999

(30) Foreign Application Priority Data

Jul. 24, 1998 (JP) ..... 10-209157
May 31, 1999 (JP) ..... 11-152110

(51) Int. Cl.[7] ..... B26F 1/04
(52) U.S. Cl. ..... 83/670; 83/687
(58) Field of Search ..... 83/433, 498, 499, 83/669, 684, 691, 670, 425.4, 667, 687

(56) References Cited

U.S. PATENT DOCUMENTS 3,192,810 * 7/1965 Amato .
4,495,582 * 1/1985 Dessert et al. ..... 364/469
5,746,162 * 5/1998 Hosoi et al. ..... 123/58.09
5,787,780 * 8/1998 Carter ..... 83/425.4
5,911,414 * 6/1999 Kato et al. ..... 270/58.07

FOREIGN PATENT DOCUMENTS 5-162919 6/1993 (JP) .
6-278095 10/1994 (JP) .
7-136995 5/1995 (JP) .
7-186098 7/1995 (JP) .
9-136762 5/1997 (JP) .
9-249348 9/1997 (JP) .
10-194568 7/1998 (JP) .

* cited by examiner

*Primary Examiner*—Kenneth E. Peterson
(74) *Attorney, Agent, or Firm*—Oblon, Spivak, McClelland, Maier & Neustadt, P.C.

(57) ABSTRACT

A sheet punch device including a punch member having a rotatable punch and a die pair that punches a hole in a sheet, a driving member that drives and rotates the punch member to punch a hole in a conveyed sheet, and in which the punch member punches holes in the conveyed sheet at plural places aligned in a sheet conveying direction. The sheet punch device further includes a sheet detecting member that is disposed upstream of the punch member in the sheet conveying direction and that detects a leading edge of the sheet being conveyed. Also included is a control device that controls the driving member such that the punch member punches a predetermined number of holes in the conveyed sheet sequentially at predetermined positions aligned in the sheet conveying direction at a predetermined time after the sheet detecting member detects a leading edge of the conveyed sheet.

18 Claims, 15 Drawing Sheets

SHEET PUNCH DEVICE AND A SHEET PUNCH METHOD

BACKGROUND OF THE INVENTION

1. Field of the Invention

This invention relates to a sheet punch device which includes a punch member to punch holes in a sheet member.

2. Discussion of the Background

A known sheet punch device, which is installed in an image forming apparatus such as a printer, a photocopying machine, a facsimile, or the like or in a sheet post-processing apparatus connected with the image forming apparatus, includes a punch member to punch holes in a sheet member, such as a sheet of paper (hereinafter referred to as a sheet). The sheet post-processing apparatus performs several operations for a sheet discharged from the image forming apparatus. The operations include, for example, a stack operation for stacking sheets on a sheet discharging tray with the sheets divided by page number, a staple operation for stapling a set of sheets and discharging the stapled sheets on the sheet discharging tray, and a punching operation for punching a sheet or sheets with the sheet punch device. Background sheet punch devices are divided into two types depending on the driving method for driving a punch and a die to punch a hole in a sheet, i.e., (1) a rotary punch method and (2) a press punch method.

As sheet punch devices of the rotary punch method, there are, for example, two types depending on the driving mechanism. In the first type of sheet punch device, a punch and a die are driven to rotate via a clutch by a motor to punch a hole in a sheet. The same motor also drives a pair of sheet conveying rollers to convey a sheet. The second type of sheet punch device includes a sheet conveying motor and another motor which drives and rotates a punch and a die mounted on a sheet conveying path, as described in Japanese Laid-open Patent Publication No. 7-136995 of 1995. In JP No. 7-136995, it is described that the second type of the sheet punch device can more precisely punch a hole at a predetermined position in a sheet than the first type of the sheet punch device, because the punch and the die are driven by a separate motor from the motor driving a pair of sheet conveying rollers to convey a sheet.

Japanese Laid-open Patent Publications No. 9-136762 (1997) and No. 9-249348 (1997) describe a sheet punch device of the press punch method, in which a hole is punched in a sheet by driving a punch and a die by a solenoid or a motor to move the punch forward and backward rectilinearly toward the die which is placed at a predetermined position.

While the sheet punch device of the press punch method punches a hole in a sheet with the sheet stopped at a certain position, the sheet punch device of the rotary punch method punches a hole in a sheet without stopping the sheet. The sheet punch device of the rotary punch method can punch a hole in an advancing sheet with a simple mechanism of rotating a punch and a die in the same direction as the sheet advancing direction. Therefore, the rotary punch method has advantages in productivity, simple mechanism, and thereby in low costs.

Another sheet punch device of the rotary punch method is proposed in Japanese Laid-open Patent Publication No. 6-278095 (1994), in which two or three punch and die pairs, which are disposed in the sheet width direction perpendicular to the sheet conveying direction, rotate synchronously with each other and punch two or three holes simultaneously at predetermined positions in a copy sheet fed from a photocopying machine (e.g., image forming apparatus).

However, the functions of the above-described background rotary sheet punch devices are limited. For example, the background sheet punch devices can only punch holes at plural positions in a sheet in the sheet width direction perpendicular to the sheet conveying direction, but cannot punch holes at plural positions in the sheet conveying direction.

Moreover, in the sheet punch device of the rotary punch method described in JP No. 6-278095, the punch and die pairs are fixed at the positions spaced a predetermined distance apart in the sheet width direction, so that the number and position of holes punched in a sheet are determined by the number of punch and die pairs in the sheet punch device. Furthermore, because the plurality of punch and die pairs perform punching operations in a sheet simultaneously, the load on each driving shaft of the punches and the dies increases. The load transmits a driving force to the punches and dies to drive them. Therefore, when the punch and die pairs are used to punch holes simultaneously, the power of a driving motor, which drives and rotates the plurality of punch and die pairs, needs to be increased.

SUMMARY OF THE INVENTION

Accordingly, an object of this invention is to overcome the above-described and other problems with background sheet punch devices, by providing a novel sheet punch device and method for punching holes in a sheet, in which a predetermined number of holes can be punched at predetermined places in a sheet aligned in a sheet conveying direction with a punch member having a rotatable punch and die pair.

A preferred embodiment of the present invention further provides a novel sheet punch device and method for punching holes in a sheet, in which a plural number of holes can be punched in a sheet aligned in a sheet conveying direction using only one rotatable punch and die pair.

Another preferred embodiment of the present invention further provides a novel sheet punch device and method for punching holes in a sheet, in which the punch member can move in the direction perpendicular to the sheet conveying direction, and thereby can punch holes in a sheet aligned in a sheet conveying direction at predetermined positions according to a size of a conveyed sheet.

Another preferred embodiment of the present invention further provides a novel sheet punch device and method for punching holes in a sheet, in which at least two holes can be punched in a sheet selectively aligned in the direction perpendicular to the sheet conveying direction.

According to a preferred embodiment of the present invention, a sheet punch device includes a punch member including a rotatable punch and die pair that punches a hole in a sheet. A driving member drives and rotates the punch member to punch a hole in a conveyed sheet, and the punch member punches holes in the conveyed sheet at plural places aligned in a sheet conveying direction.

According to the present invention, the sheet punch device may further include a sheet detecting member that is disposed upstream of the punch member in the sheet conveying direction and that detects a leading edge of the sheet being conveyed. A control device controls the driving member such that the punch member punches a predetermined number of holes in the conveyed sheet sequentially at predetermined positions aligned in the sheet conveying direction a predetermined time after the sheet detecting member detects a leading edge of the conveyed sheet.

The control device may control the driving member according to a size of the conveyed sheet.

The sheet punch device may further include a first punch hole information setting device to set information for punching holes in the conveyed sheet at plural places aligned in the sheet conveying direction, and the control device may control the driving member based on signals from the first punch hole information setting device.

Alternatively, the control device may control the driving member according to a size of the conveyed sheet and based on signals from the first punch hole information setting device.

According to the present invention, the sheet punch device may further include a moving/driving device configured to move the punch member in a direction perpendicular to the sheet conveying direction. The control device controls the moving/driving device such that the punch member stops moving when the punch member reaches a position at a predetermined distance apart from a position corresponding to a side edge of a sheet at a side of the punch member in the direction perpendicular to the sheet conveying direction, and controls the driving member such that the punch member punches the predetermined number of holes in the conveyed sheet sequentially at predetermined positions aligned in the sheet conveying direction, according to a size of the conveyed sheet.

Alternatively, the control device may control the moving/driving device based on signals from the first punch hole information setting device, or according to a size of the conveyed sheet and based on signals from the first punch hole information setting device.

According to the present invention, the sheet punch device may further include a second punch member including a rotatable punch and die pair that punches a hole in a sheet. The second punch member may be positioned at a predetermined distance from the punch member in a direction perpendicular to the sheet conveying direction and may be rotated by the second driving member.

Further, the second punch member may be fixed and the sheet punch device may punch holes in a sheet at least at two places in the direction perpendicular to the sheet conveying direction with the first and second punch members.

The sheet punch device may further include a second punch hole information setting device to set punch hole information for punching holes in a sheet at plural places aligned in the sheet conveying direction or another punch hole information for punching holes in a sheet at plural places aligned in the direction perpendicular to the sheet conveying direction. The sheet punch device punches holes in a sheet based on signals from either the first punch hole information setting device or the second punch hole information setting device.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
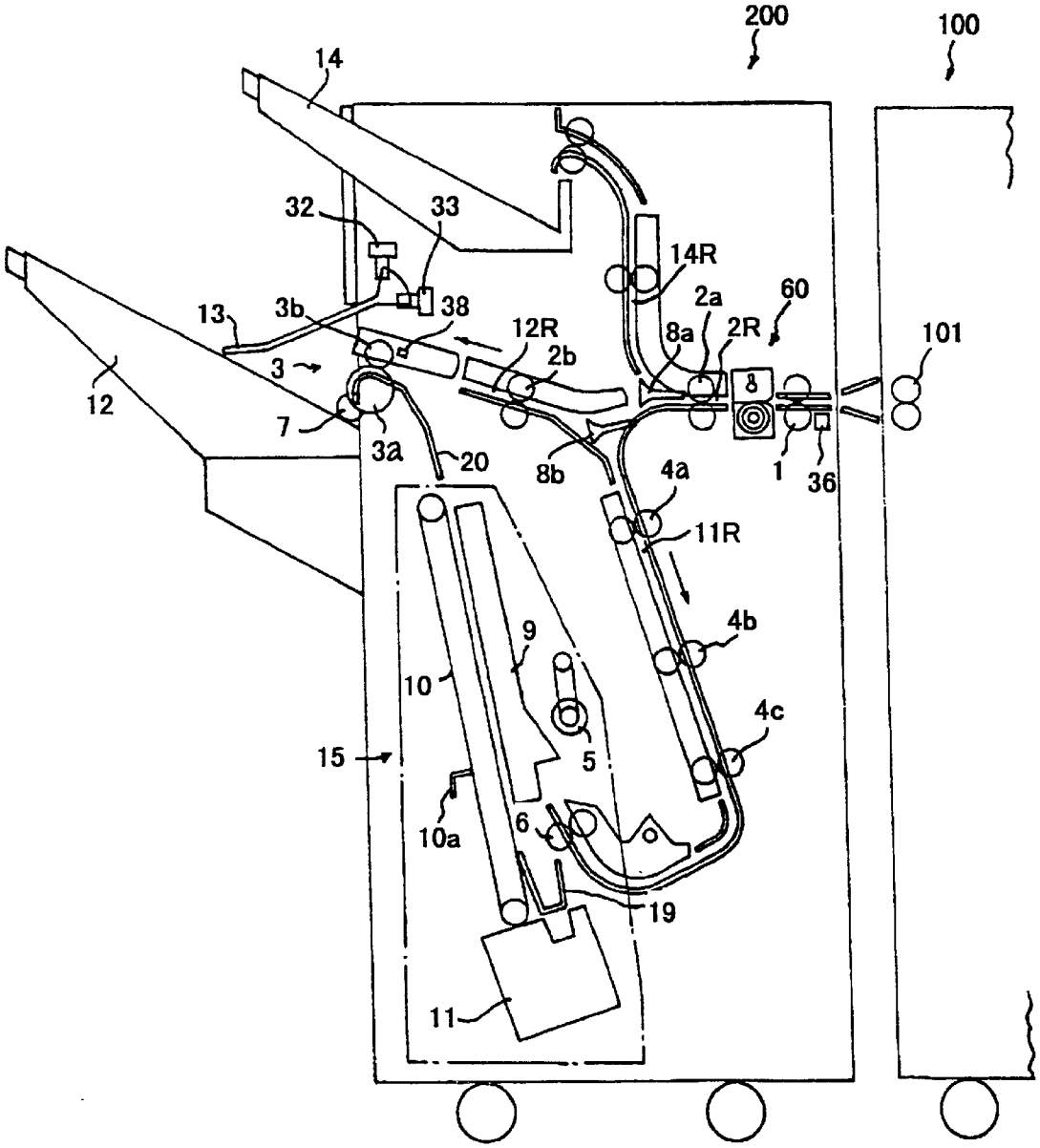
FIG. 1 is a schematic drawing illustrating an overall structure of a sheet post-processing apparatus having a sheet punch device of the present invention.

Referring now to the drawings, wherein like reference numerals designate identical or corresponding parts throughout the several views, a first embodiment of the present invention is now described referring to FIG. 1 through FIG. 9.

In FIG. 1, a reference numeral 100 designates an image forming apparatus, such as a photocopying machine that makes photocopies on a sheet of paper. A reference numeral 200 designates a sheet post-processing apparatus connected to the side of the image forming apparatus 100. A reference numeral 101 designates discharging rollers provided at a sheet discharging part of the image forming apparatus 100. In the vicinity of an entrance of a sheet conveying path 2R of the sheet post-processing apparatus 200, which connects to the discharging rollers 101 of the image forming apparatus 100, there are arranged an entrance sensor 36, entrance rollers 1, a rotary punch unit 60 including a sheet punch device, exit rollers 2*a,* and separation guide picks 8*a* and 8*b,* along the sheet conveying path 2R in the order described in the sheet conveying direction.

Figure 2:
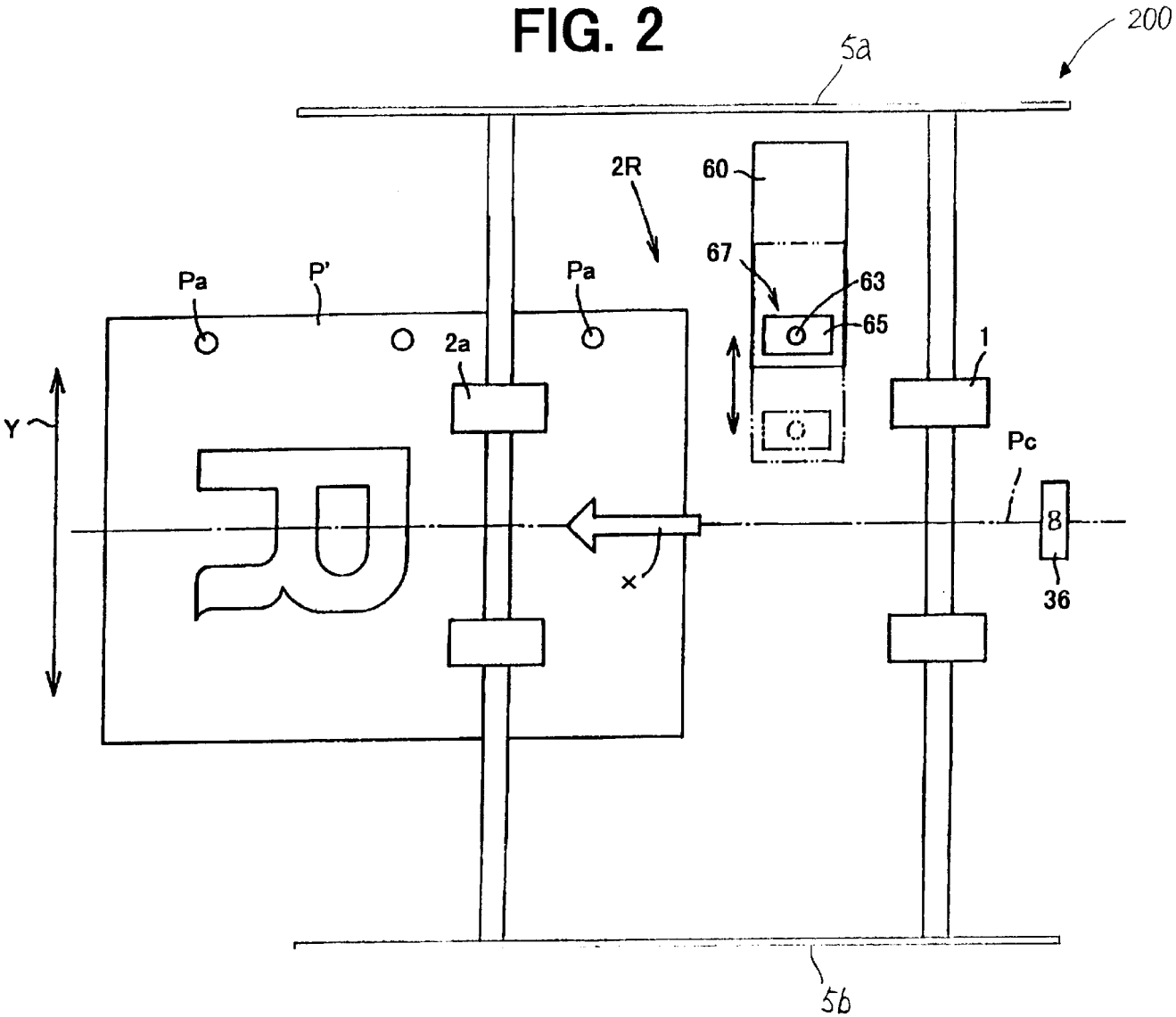
FIG. 2 is a top plane view illustrating surrounding parts of a punch unit of the sheet punch device of the sheet post-processing apparatus of FIG. 1.

The entrance rollers 1 and exit rollers 2*a* each include a pair of rollers, and are rotatively supported by respective shafts. As illustrated in FIG. 2, the respective shafts extend between a pair of side boards 5*a* and 5*b* provided on each side of the sheet conveying path 2R of the sheet post-processing apparatus 200, and oppose each other in the direction perpendicular to the sheet conveying direction indicated by an arrow Y (hereinafter referred to as a sheet width direction Y). The entrance rollers 1 receive a sheet conveyed from the discharging rollers 101 of the image forming apparatus 100 and transfer the sheet in the downstream direction of the sheet conveying path 2R. The exit rollers 2*a* are provided immediately downstream of the rotary punch unit 60, and transfer the sheet conveyed from the entrance rollers 1 via the rotary punch unit 60 in the downstream direction of the sheet conveying path 2R. The entrance rollers 1 and the exit rollers 2*a* are in a relationship in which a rotational force is transmitted to each other via a rotational force transmission device, such as a timing belt (not shown) and a belt pulley (not shown). The entrance rollers 1 and the exit rollers 2*a* are driven to rotate by a sheet conveying/driving device, such as a stepping motor (not shown).

The entrance sensor 36 is disposed upstream of the rotary punch unit 60 in the sheet conveying direction indicated by an arrow X (hereinafter referred to as a sheet conveying direction X) as illustrated in FIG. 2. The entrance sensor 36 detects leading and trailing edges of the sheet conveyed from the discharging rollers 101, and thus serves as a sheet edge detecting device. The separation guide picks 8*a* and 8*b* are driven by a solenoid (not shown) and a spring (not shown) to direct the sheet selectively toward a sheet discharging tray 12, a proof tray 14, and a staple unit 11.

On and around a sheet conveying path 12R for sorting and stacking sheets, which extends from the sheet conveying path 2R to the sheet discharging tray 12, there are arranged upper transfer rollers 2*b,* a sheet discharging sensor 38, discharging rollers 3, a shift roller 7, a sheet surface detecting lever 13, and sheet surface detecting sensors 32 and 33.

The upper transfer rollers 2*b* include a pair of rollers like the entrance rollers 1 and the exit rollers 2*a,* and transfer the sheet in the downstream direction of the sheet conveying path 12R. The discharging sensor 38 detects the sheet directed toward the discharging rollers 3. The discharging rollers 3 include a drive roller 3*a* and a driven roller 3*b* and serve to transfer and discharge the sheet, which is conveyed from the sheet conveying path 12R or a sheet conveying path 11R (described later), to the sheet discharging tray 12. The shift roller 7 has a function to shift the sheet to one side of the discharging tray 12. The sheet surface detecting lever 13 is supported so as to seesaw. One end of the sheet surface detecting lever 13 is disposed to contact the sheet discharging tray 12 when no sheet is stacked thereon. As sheets are stacked on the sheet discharging tray 12, one end of the sheet surface detecting lever 13 contacting the surface of the sheets stacked on the sheet discharging tray 12 raises. The other end is disposed so as to be detected by the sheet surface detecting sensors 32 and 33. The sheet surface detecting sensors 32 and 33 detect that the sheet discharging tray 12 is at the home position, the height of the stacked sheets on the discharging tray 12 exceeds a predetermined height, and so on, in cooperation with the sheet surface detecting lever 13 (the details are described later). The driven roller 3*b* contacts and presses the drive roller 3*a* by its gravity or by a bias force of a spring (not shown) or the like. A sheet or a set of stapled sheets are discharged to the sheet discharging tray 12 by the driven roller 3*b* pressing against the drive roller 3*a*.

A plurality of transfer roller pairs are arranged on the sheet conveying path 14R which extends from the sheet conveying path 2R to the proof tray 14. The proof tray 14 receives cut-in sheets conveyed from the image forming apparatus 100 as a result of a cut-in job, such as printing a received fax which is performed by interrupting a copying job in the image forming apparatus 100.

On a sheet conveying path 11R for stapling, which extends from the sheet conveying path 2R to the staple unit 11, there are provided transfer roller pairs 4*a,* 4*b,* and 4*c,* a sheet discharging sensor (not shown), and a staple device 15 including brush-shaped sheet transfer rollers 6. Each transfer roller pairs 4*a,* 4*b,* and 4*c* is driven by a transfer motor (not shown).

The staple device 15 includes a staple tray (not shown) and the staple unit 11. The staple unit 11 is provided under the staple tray. On the staple tray, there are provided jogger fences 9 to align the sheet, a return roller 5, and a release belt 10 located at the back side of the staple tray to discharge a set of stapled sheets. A reference numeral 10*a* designates a release pick fixed on the release belt 10 to hold a trailing edge of a set of sheets stapled with the staple unit 11.

The jogger fences 9 are configured to move in the sheet width direction via a jogger belt (not shown) driven by a jogger motor (not shown), and the return roller 5 is configured to swing to contact and separate from the surface of the sheet stacked in the staple tray by a return solenoid (not shown). An end fence 19 is provided under the jogger fences 9 to abut on trailing edges of the sheets stacked in the staple tray.

The staple unit 11 is driven by a staple moving motor (not shown) via a staple belt (not shown) and moves between the front and rear sides of the sheet post-processing apparatus 200 in the direction perpendicular to the paper surface of FIG. 1. The set of sheets stapled with the staple unit 11 is discharged to the sheet discharging tray 12 by rotations of the release belt 10 driven by a release motor (not shown) with the trailing edge of the sheets held by the release pick 10*a* and with the sheets directed by guide plates 20. A further detailed description for the configuration of the staple device 15 is omitted, because the configuration of the staple device 15 is not relevant to the present invention.

The sheet discharging tray 12 is hung by an up-down lift belt (not shown). The up-down lift belt is driven by an up-down motor (not shown) via gears including worm gears and a timing belt (not shown), and moves up and down by forward and reverse rotations of the up-down motor. Further, the sheet discharging tray 12 moves in the direction perpendicular to the sheet conveying direction by being driven by a shift motor (not shown).

When the sheet discharging tray is at a home position, i.e., when no sheet is stacked on the sheet discharging tray 12, the other end of the sheet surface detecting lever 13 is detected by both of the sheet surface detecting sensors 32 and 33. Thereby, it is detected that the sheet discharging tray 12 is at the home position. As sheets are discharged and stacked on the sheet discharging tray 12, the one end of the sheet surface detecting lever 13 is raised by the stacked sheets. When the height of the stacked sheets reaches a predetermined height at which the other end of the sheet surface detecting lever 13 is only detected by the sheet surface detecting sensor 33, the sheet discharging tray 12 starts to move down so as to receive additional sheets. The sheet discharging tray 12 moves down until the another end of the sheet surface detecting lever 13 is detected by both the sheet surface detecting sensors 32 and 33. As additional sheets are stacked on the sheet discharging tray 12, the sheet discharging tray 12 moves down. When a lower limit sensor (not shown) detects the sheet discharging tray 12, the sheet discharging tray 12 stops moving. When the stacked sheets are taken away from the sheet discharging tray 12, the one end of the sheet surface detecting lever 13 swings down such that the other end of the sheet surface detecting lever 13 is only detected by the sheet surface detecting sensor 32. Upon detection of the other end of the sheet surface detecting lever 13 with the sheet surface detecting sensor 32, the sheet discharging tray 12 starts to move up until the other end of the sheet surface detecting lever 13 is detected by both of the sheet surface detecting sensors 32 and 33 (i.e., to the home position of the sheet discharging tray 12). When the sheet discharging tray 12 moves up and pushes the shift roller 7, and an upper limit switch (not shown) is turned off, the up-down motor stops rotating and the sheet discharging tray 12 stops. Thus, the sheet discharging tray 12 is not broken due to an overrun.

Figure 3:
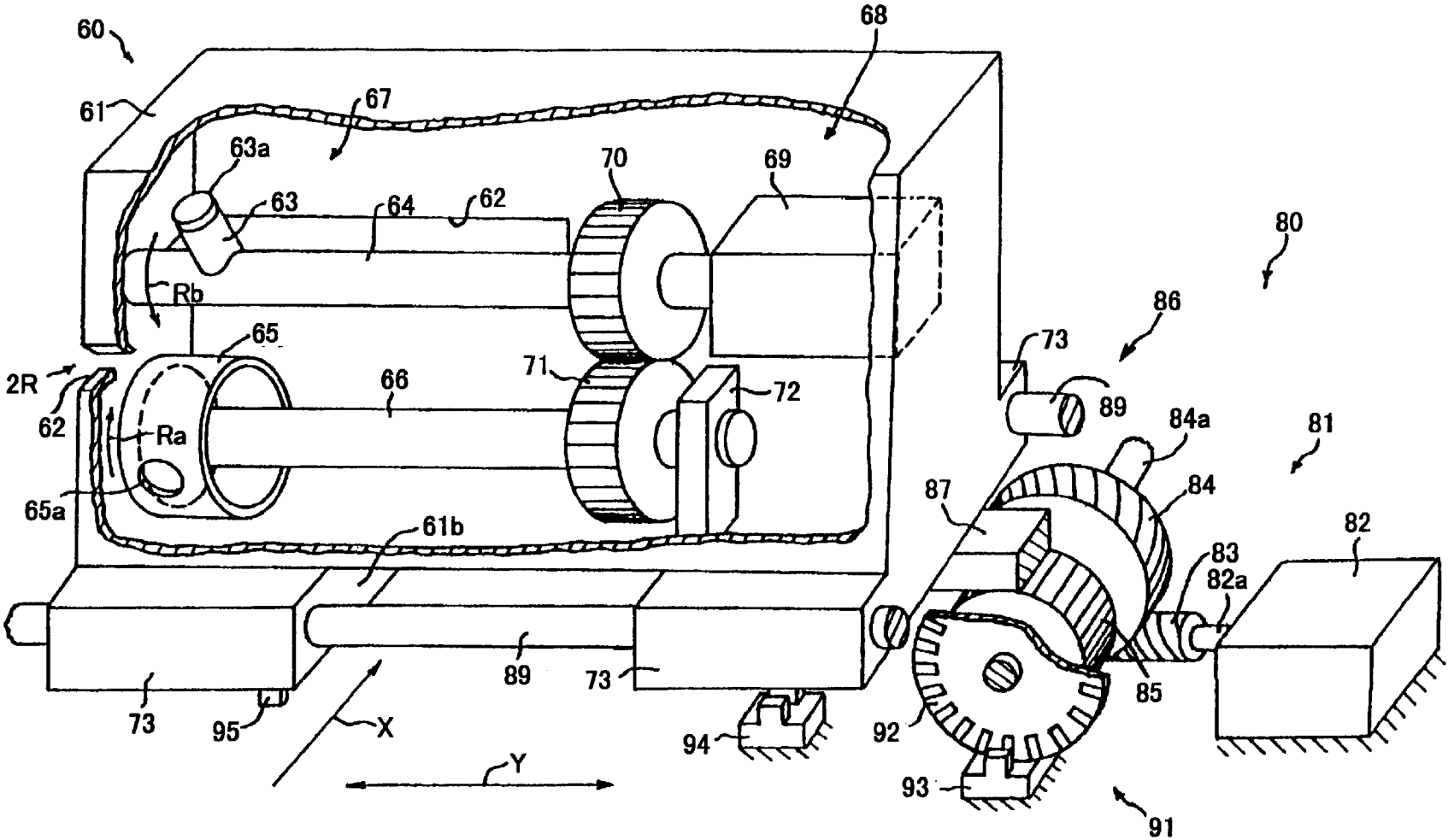
FIG. 3 is a partial broken perspective view illustrating the punch unit and a moving mechanism to move the punch unit, according to first and second embodiments of the present invention.

The configuration of the rotary punch unit 60 (hereinafter called the punch unit 60) and surrounding parts are now described. As illustrated in FIGS. 2 and 3, the punch unit 60 includes a punch member 67 having a punch 63 and a die 65 (i.e., a punch and die pair), which is rotatable to punch a hole (Pa) in a sheet P'. Also included is a driving mechanism 68 including a punch motor 69 serving as a driving device to rotate the punch 63 and the die 65, and a housing case 61 that houses the punch member 67 and the driving mechanism 68. A moving mechanism 80 moves the punch unit 60 in the sheet width direction Y which is perpendicular to the sheet conveying direction X. The moving mechanism 80 has a configuration and a function of a moving device to move the punch unit 60 in the sheet width direction Y. The driving mechanism 68 includes the punch motor 69, a drive gear 70, a punch shaft 64, a driven gear 71, and a die shaft 66.

Hereinafter will be described the configurations of the punch unit 60 and the moving mechanism 80. The housing case 61 of the punch unit 60 is molded of plastics. In addition, reinforcing parts made of steel plates, etc. are integrated in the housing case 61. The housing case 61 extends longitudinally along the sheet width direction Y as illustrated in FIG. 3. At front and rear sides of the side walls of the housing case 61 in FIG. 3, openings 62 are formed as a part of the sheet conveying path 2R to receive the sheet conveyed from the entrance rollers 1. The openings 62 are provided such that the punch unit 60 can move in a predetermined range in the sheet width direction Y. At the bottom of the housing case 61, sliding parts 73 are integrally formed with the housing case 61 at both left and right sides as illustrated in FIG. 3. The sliding parts 73 include insert holes into which guide/support rods 89 fixed to the sheet post-processing apparatus 200 are inserted loosely (the details are described later). Further, at the middle of the left and right sliding parts 73 in the sheet conveying direction X in FIG. 3, a rack 87 is formed integrally with the housing case 61 protruding downward. On the bottom surface of the left-hand sliding part 73 in FIG. 3, a detecting member 95 is mounted and protrudes downward so as to be engaged with a home position sensor 94 which will be described later.

The punch 63 includes a punch blade 63*a,* and is mounted perpendicularly to the punch shaft 64. One end of the punch shaft 64 is rotatably supported on the left-hand wall of the housing case 61 in FIG. 3. The other end of the punch shaft 64 connects to an output shaft of the punch motor 69 via the drive gear 70 which is fixed on the punch shaft 64. The punch motor 69 includes, for example, a stepping motor, and is fixed on the right-hand wall of the housing case 61 in FIG. 3. The punch motor 69 connects with a power source (not shown) of the sheet post-processing apparatus 200 and with a control device (not shown and described later) by flexible signal wires. The stepping motor of the punch motor 69 is separate from the aforementioned stepping motor serving as the sheet conveying/driving device.

The die 65 is cylindrical-shaped and includes a hole-shaped blade 65*a,* which is engaged with the punch blade 63*a*. The die 65 is disposed facing the punch 63 across the sheet conveying path 2R, and is mounted perpendicularly to the die shaft 66. One end of the die shaft 66 is rotatably supported on the left-hand wall of the housing case 61 in FIG. 3. The other end of the die shaft 66 is rotatably supported with a plumb member 72, which is placed on the bottom wall of the housing case 61 in a standing condition, via the driven gear 71 fixed on the die shaft 66 and is engaged with the drive gear 70. At the lower part of the housing case 61, a container 61*b* is provided to contain punch dust (not shown), which is produced when a sheet is punched by rotations of the punch 63 and the die 65. Inside the housing case 61, partition walls (not shown) are provided to separate the arranged elements of the punch member 67 and those of the driving mechanism 68 to prevent the punch dust from flowing toward the driving mechanism 68.

On the shaft between the punch motor 69 and the drive gear 70, an encoder (not shown) having a slit disk shape is mounted to detect the home position of the punch 63 and the die 65 in cooperation with a home position sensor (not shown). The home position sensor is mounted on the upper wall of the housing case 61 near the above-described encoder. The home position sensor includes, for example, a transmissive photosensor having light-emitting and light-receiving elements. The hole position sensor is disposed such that the outer regions of the encoder pass between the light-emitting and light-receiving elements. In the home position of the punch 63, the top face of the punch blade 63*a* is directed vertically upward, and in the home position of the die 65, the hole-shaped blade 65*a* is directed vertically downward.

Rotations of the punch motor 69 cause the punch 63 and the die 65 to rotate in opposite directions respectively synchronizing with each other. Specifically, the punch 63 rotates in the direction indicated by an arrow Rb and the die 65 rotates in the direction indicated by an arrow Ra as illustrated in FIGS. 3 and 6.

In the first embodiment of the present invention, because a stepping motor is used as the punch motor 69 as a driving device to rotate the punch 63 and die 65, the rotational position and speed of the punch 63 and die 65 can be controlled easily, surely, and accurately with a simple control configuration.

The moving mechanism 80 includes a moving/driving device 81 that moves the punch unit 60 in the sheet width direction Y, and a guide/support device 86 that guides and supports the punch unit 60 in the sheet width direction Y. The moving/driving device 81 and the guide/support device 86 are provided between the pair of side boards 5*a* and 5*b* of the sheet post-processing apparatus 200 illustrated in FIG. 2.

The moving/driving device 81 includes a reversible move motor 82 which is secured to a fixed member (not shown) fixed to the side boards 5*a* and 5*b,* and a worm 83 fixed to an output shaft 82*a* of the move motor 82. Also included is a wheel shaft 84*a,* whose ends are rotatively supported with a pair of plumb members (not shown) which are fixed to the above-described fixed member (not shown) at the front and rear sides in FIG. 3, a worm wheel 84 which is fixed to one end of the wheel shaft 84*a* and is always engaged with the worm 83, a pinion 85 which is fixed to the front side end of the wheel shaft 84*a* in FIG. 3, and a rack 87 which is always engaged with the pinion 85.

The guide/support device 86 includes two guide/support rods 89 which extend in the sheet width direction Y, and are fixed between the side boards 5*a* and 5*b*. The guide/support rods 89 are inserted loosely in the above-described insert holes formed in the sliding parts 73 of the housing case 61. The two guide/support rods 89 extend in parallel to each other at the same height in the direction perpendicular to the side boards 5*a* and 5*b*.

Figure 5:
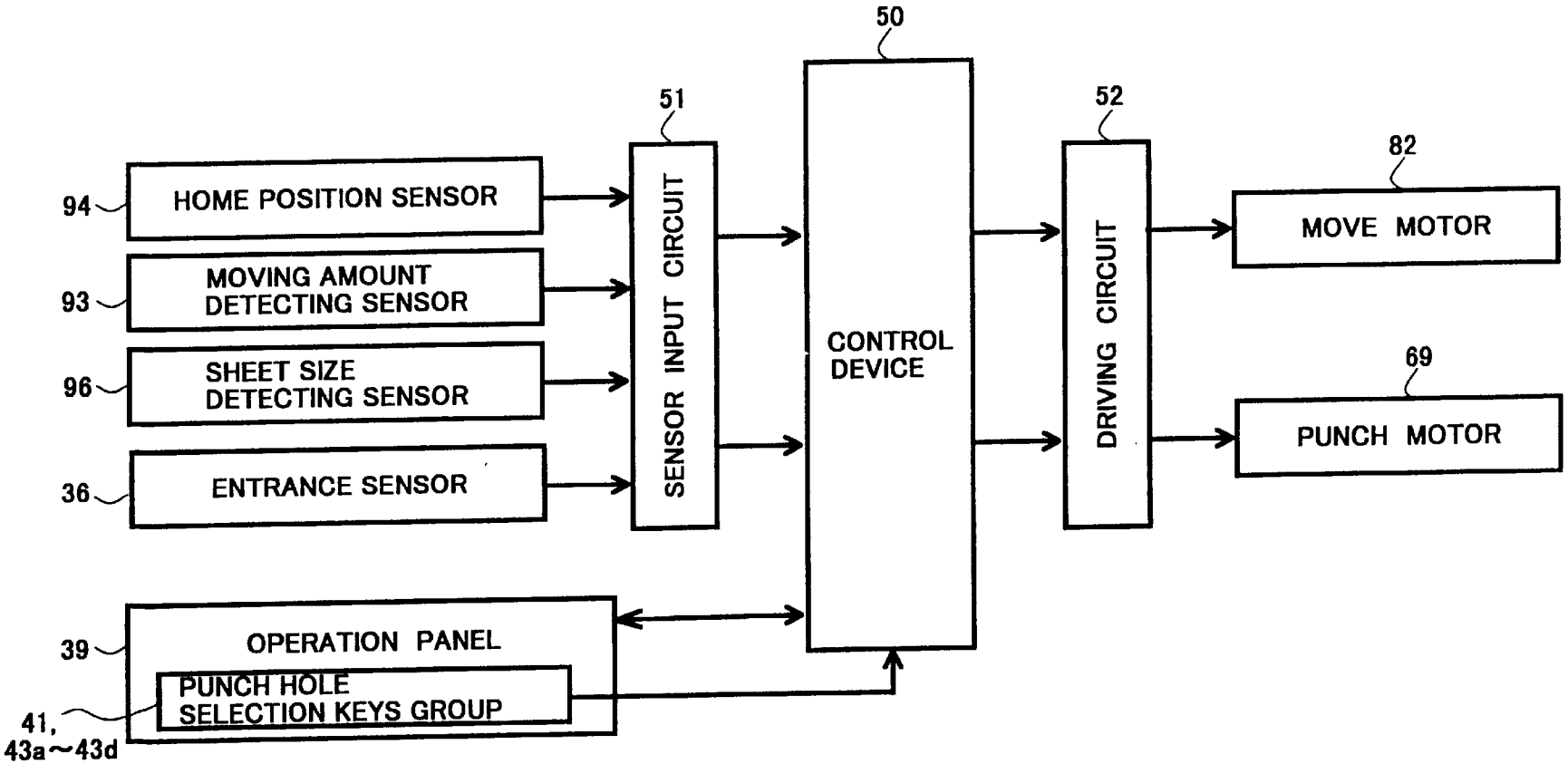
FIG. 5 is a block diagram illustrating a configuration of a control part of the sheet punch device, according to the first embodiment of the present invention.

Referring to FIG. 3, a reference numeral 91 designates a moving amount detecting device. The moving amount detecting device 91 includes an encoder 92 having a slit disk shape and a moving amount detecting sensor 93. As illustrated in FIG. 3, the encoder 92 includes a plurality of slits and is fixed to one end of the wheel shaft 84*a*. The moving amount detecting sensor 93 is fixed to the above-described fixed member (not shown) located under the encoder 92 with the encoder 92 sandwiched therebetween. The moving amount detecting sensor 93 is a photosensor of photointerrupter type with a known configuration including light-emitting and light-receiving elements. The rotation amount (the number of times of rotation) of the wheel shaft 84*a* or the pinion 85 is detected by cooperative operations of the moving amount detecting sensor 93 and the rotating encoder 92. The moving amount of the punch unit 60 is calculated according to a detected result by a control device 50, which is described later and is illustrated in FIG. 5.

The home position sensor 94 is fixed on the above-described fixed member (not shown) near the moving amount detecting sensor 93, and detects the home position of the punch unit 60 while being engaged with the detecting member 95 which is mounted on the housing case 61. The home position sensor 94 includes a transmissive photosensor having light-emitting and light-receiving elements.

Figure 4A:
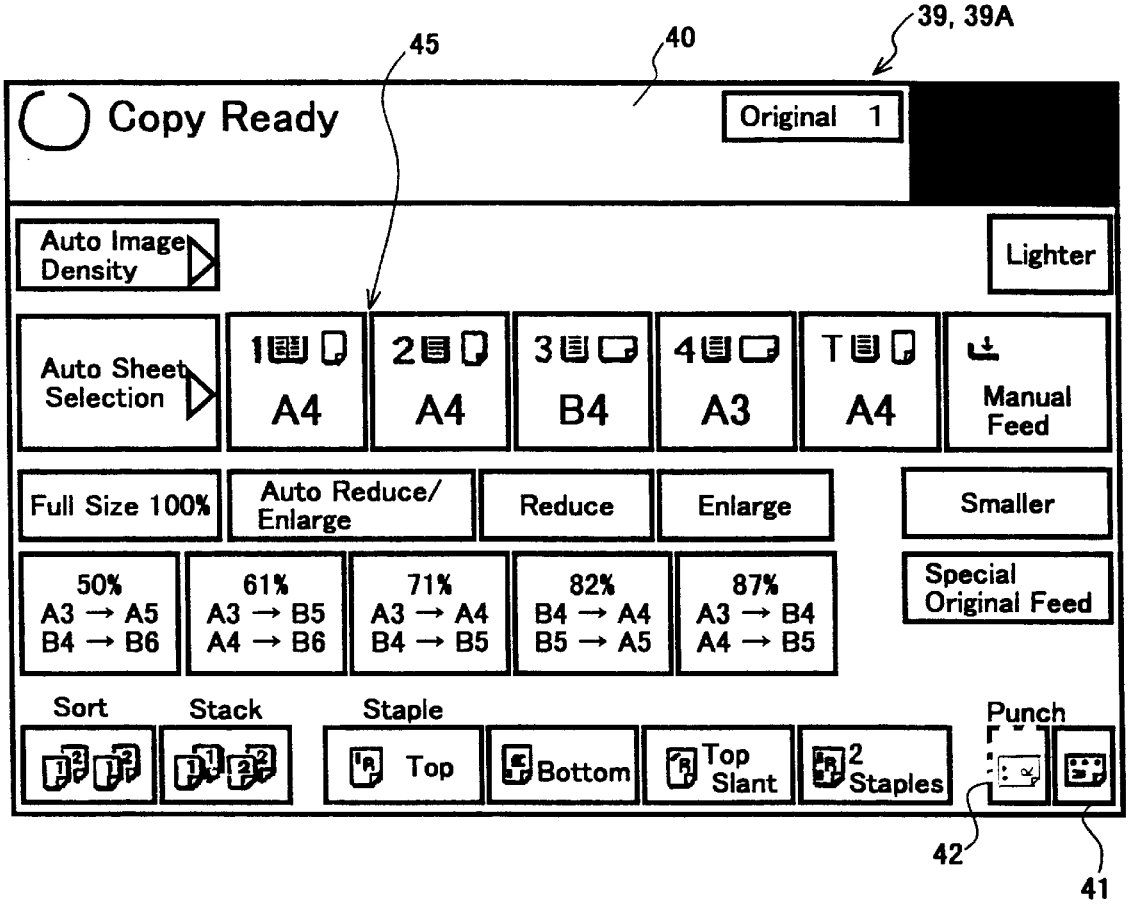
FIG. 4A is a top plane view illustrating an operation panel of an image forming apparatus of the present invention.
Figure 4B:
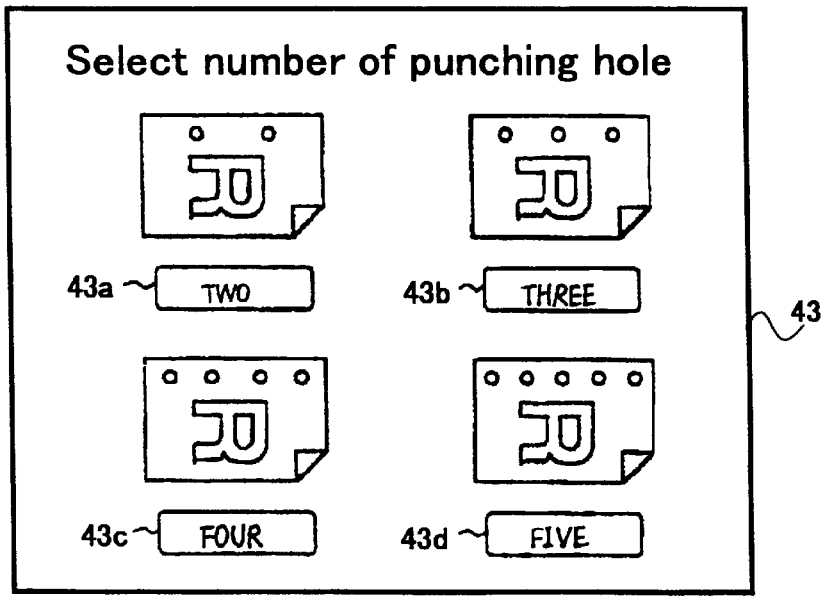
FIG. 4B is a top plane view illustrating a punch hole selection display of the operation panel according to the first and third embodiments of the present invention.

Next, a detailed configuration of an operation panel 39 of the image forming apparatus 100 is described referring to FIGS. 4A and 4B. The operation panel 39 is arranged at an upper part of the image forming apparatus 100 and displays a start key for instructing and inputting a starting operation for copying, number keys for instructing and inputting a number of copies, and keys necessary for instructing and inputting a punching operation. In FIG. 4A, moreover, the operation panel 39 illustrates only the keys necessary for the punching operation and omits illustrations of the start key and the number keys. On the operation panel 39, there are arranged a menu display 40, a punch hole selection key 41, a group of sheet selection keys 45, etc., of a touch panel method that are displayed and set on the menu display 40, which is displayed when a power switch (not shown) of the image forming apparatus 100 is turned on. The punch hole selection key 41 is used for inputting information about punched holes aligned in the sheet conveying direction X. A reference numeral 42 designates a punch hole selection key which is used for inputting information about punched holes aligned in the sheet width direction Y. The punch hole selection key 42 is indicated by an imaginary line in FIG. 4A. Though the punch hole selection key 42 is not used in the first embodiment, it is illustrated in FIG. 4A for the later described second embodiment to avoid redundancy of figures.

The menu display 40 and a punch hole selection display 43 (not shown in FIG. 4A and will be described later) displayed on the operation panel 39 include a liquid crystal display (LCD) device which is driven via a liquid crystal drive circuit (not shown). The punch hole selection key 41 and the punch hole selection key 42 serve as a punch operation setting device to input and set instructions for punch mode operations. When the punch hole selection key 41 is pushed, the display thereof is reversed, and an operation for punching holes in the sheet conveying direction X becomes ready. The display of the punch hole selection key 41 is enlarged to the size of the bottom half of the menu display 40, and is then switched to the punch hole selection display 43 as illustrated in FIG. 4B. On the punch hole selection display 43, illustrations are displayed for inputting the instruction for punching holes at plural places in a sheet in the sheet conveying direction X and to select the number of punch holes. In addition, each punch hole number selection key corresponds to the number of holes punched in the sheet conveying direction X and is displayed below the above-described respective illustrations.

Specifically, on the punch hole selection display 43, there are displayed punch hole number selection keys 43*a,* 43*b,* 43*c,* and 43*d* for inputting instructions for punching holes in the sheet conveying direction X at a predetermined two, three, four, and five places, respectively. An operator may select and push any one of the punch hole number selection keys 43*a,* 43*b,* 43*c,* and 43*d* corresponding to the illustration of a desired number of punch holes. When the operator selects and pushes any one of the punch hole number selection keys 43*a,* 43*b,* 43*c,* and 43*d,* the display of the selected punch hole number selection key and its corresponding illustration is reversed, and thereby the punch operation for the desired number of holes is set. Hereinafter, the punch hole selection key 41 and the punch hole number selection keys 43*a,* 43*b,* 43*c,* and 43*d* may generally be called a punch hole selection keys group 41, 43*a,* 43*b,* 43*c,* and 43*d*.

The punch hole selection keys group 41, 43*a,* 43*b,* 43*c,* and 43*d* serves as a first punch hole information setting device to set the information for punching holes at plural places in a sheet in the sheet conveying direction X.

As the sheet selection keys group 45, there are arranged several kinds of well-known setting keys such as an auto sheet selection key, selection keys for an A4, B4, and A3 sized sheet, and a manual feed selection key. A4, B4, and A3 sized sheets are stacked in respective sheet feeding cassettes of a sheet feeding unit which is disposed in the image forming apparatus 100.

Referring to FIG. 5, a configuration of a control part of the sheet punch device according to the first embodiment of the present invention is described. For the sake of simplification of the description, the configuration related to a movement of the punch unit 60 in the sheet width direction Y and a punching operation are only illustrated, and the configuration related to a sheet transfer and transmission and receipt of information to and from a control device of the image forming apparatus 100 are omitted in FIG. 5.

Referring to FIG. 5, a reference numeral 50 designates a control device. The control device 50 controls a movement of the punch unit 60 in the sheet width direction Y and a punching operation. The control device 50 includes a micro computer with a CPU (central processing unit), a RAM (random-access memory), a ROM (read only memory), an I/O (input/output) port, and a timer, which are connected to each other via a signal bus, and are not shown in FIG. 5.

Each output signal from the home position sensor 94, the moving amount detecting sensor 93, a sheet size detecting sensor 96, and the entrance sensor 36 is input to the control device 50 via a sensor input circuit 51. In addition, output signals from the punch hole selection keys group 41, 43*a*, 43*b*, 43*c*, 43*d* of the operation panel 39 are input to the control device 50. The sheet size detecting sensor 96 is provided in the image forming apparatus 100, and has a well-known configuration to detect the size of the selected sheet, such as a configuration of a plurality of photosensors of a light reflection type to detect the sheet width and length in the sheet feeding trays. The control device 50 judges a sheet size based on output signals from each photosensor of the sheet size detecting sensor 96.

The control device 50 transmits instruction signals to the move motor 82 and the punch motor 69 via a drive circuit 52 based on the above-described input signals. Further, the control device 50 transmits instruction signals to the above-described LCD of the operation panel 39 based on the input signals.

The control device 50 controls the move motor 82 based on each signal from the sheet size detecting sensor 96, the home position sensor 94, and the moving amount detecting sensor 93, such that the punch unit 60 stops moving when it reaches a position at a predetermined distance apart from a side edge of a sheet at the side of the punch unit 60 in the sheet width direction Y according to a sheet size. A predetermined time after the entrance sensor 36 detects the leading edge of the sheet, the control device 50 controls the punch motor 69 such that a predetermined number of holes are punched at predetermined positions in the sheet in the sheet conveying direction X based on each signal from the punch hole selection keys group 41, 43*a*, 43*b*, 43*c*, and 43*d*.

The control device 50 detects a rotational position of the punch 63 separately from the detection of the home position of the punch unit 60 with the home position sensor 94. In other words, the control device 50 functions as a pulse calculation device to calculate the drive pulses applied to the punch motor 69. A clock pulse generation circuit (not shown) contained in the control device 50 performs this function. The aforementioned timer of the microcomputer in the control device 50 times the time period after the entrance sensor 36 detects the leading edge of the sheet. The above-described ROM of the microcomputer in the control device 50 stores data for controlling the move motor 82 and the punch motor 69, and a program corresponding to a punch mode operation flow in FIG. 9.

Next, operations of the sheet post-processing apparatus 200 are described. The description of operations in a non-staple mode without staple operations, such as a sort mode and a stack mode and operations in a staple mode with staple operations are omitted, as it is not relevant to the present invention. Therefore, operations of the sheet post-processing apparatus 200 when a punch mode is selected, are only described hereinafter.

In the first embodiment, as illustrated in FIG. 2, the conveyed sheet P' is aligned with a center position Pc in the sheet width direction Y regardless of a sheet size (hereinafter called a center standard sheet conveying method).

Before starting operations of the image forming apparatus 100 and the sheet post-processing apparatus 200, an operator inputs and sets instructions necessary for a punching operation, for example, with the punch hole selection keys group 41, 43*a*, 43*b*, 43*c*, 43*d* and the sheet selection keys group 45. Specifically, when the power switch of the image forming apparatus 100 is turned on, the menu display 40 is displayed on the operation panel 39 as illustrated in FIG. 4A. When the punch hole selection key 41 is pushed, the display thereof is reversed and enlarged to the bottom half of the menu display 40, and is then switched to the punch hole selection display 43 as illustrated in FIG. 4B.

Figure 8:
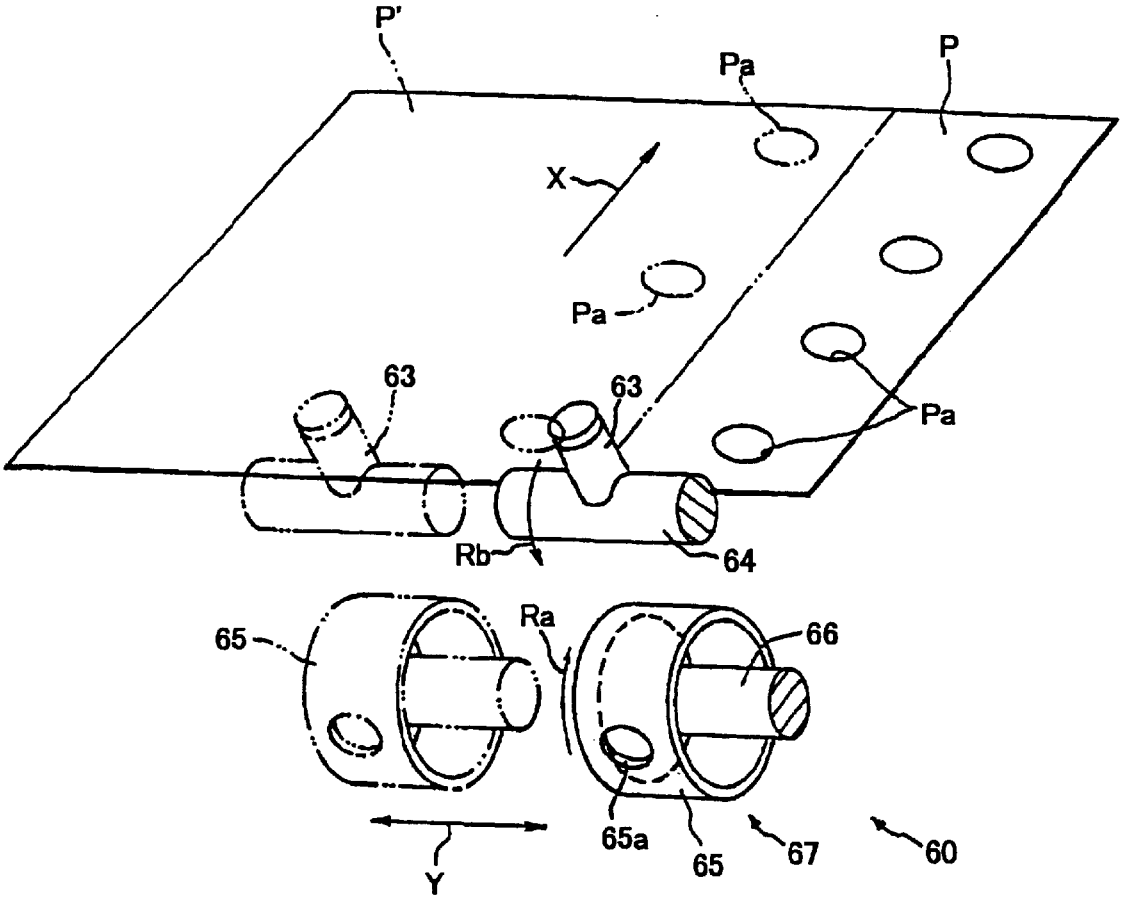
FIG. 8 is a perspective view illustrating moving and punching conditions of the punch and the die according to a sheet size of the first embodiment of the present invention.

For example, when the operator desires to punch holes (Pa) at three predetermined places in a small size sheet P' in the sheet conveying direction X as illustrated in FIG. 2, the operator pushes the punch hole number selection key 43*b*. When the operator desires to punch holes (Pa) at four predetermined places in a large size sheet P in the sheet conveying direction X as illustrated in FIG. 8, the operator pushes the punch hole number selection key 43*c*. Before or after the above-described setting operations for the number of holes, the operator inputs an instruction for selecting a desired sheet size from those stacked in the sheet feeding trays with the sheet selection keys group 45. Alternatively, the operator may input an instruction for an auto sheet selecting function with the auto sheet selection key, in which the corresponding sheet is automatically selected from those stacked in the sheet feeding trays based on the size of an original document. Thereafter, when the operator pushes the start key after setting the number of copies with the number keys, predetermined copy operations start in the image forming apparatus 100.

Subsequently, the sheet size detecting sensor 96 in FIG. 5 detects the size of the sheet being used, and an output signal relating to the sheet size is input to the control device 50. Then, the control device 50 controls the move motor 82, based on each signal from the sheet size detecting sensor 96, the home position sensor 94, and the moving amount detecting sensor 93, such that the punch unit 60 stops moving after the punch unit 60 moves to a predetermined punch position according to the sheet size.

Referring to FIG. 3, specifically for the operation of the punch unit 60, the move motor 82 is driven to rotate in accordance with the instruction of the control device 50 (FIG. 5). The driving force is transmitted to the punch unit 60 via the worm 83, the worm wheel 84, the pinion 85, and the rack 87. Thereby, the punch unit 60 starts to move from the home position (standby position) in the sheet width direction Y with the housing case 61 guided and supported by each guide/support rod 89. Then, as illustrated in FIG. 8, the punch unit 60 stops moving when the punch unit 60 reaches a position a predetermined distance apart from the side edge of the sheet P or P' at the side of the punch unit 60 in the sheet width direction Y according to a sheet size.

Figure 6A:
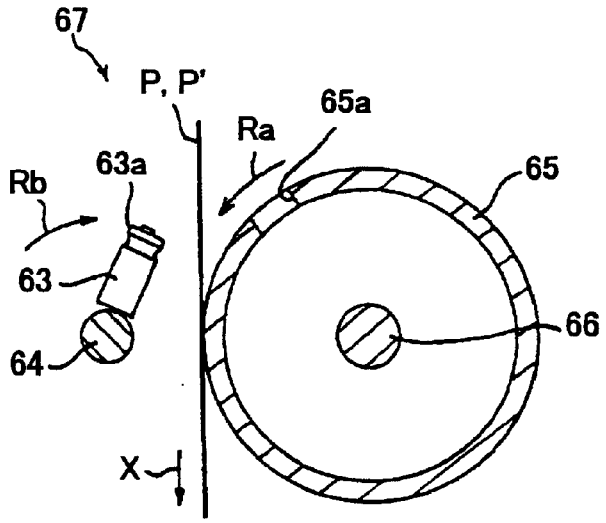
FIG. 6A to FIG. 6C are cross sectional views of a punch and die of a punch member explaining a punching operation of the punch member of the present invention.
Figure 9:
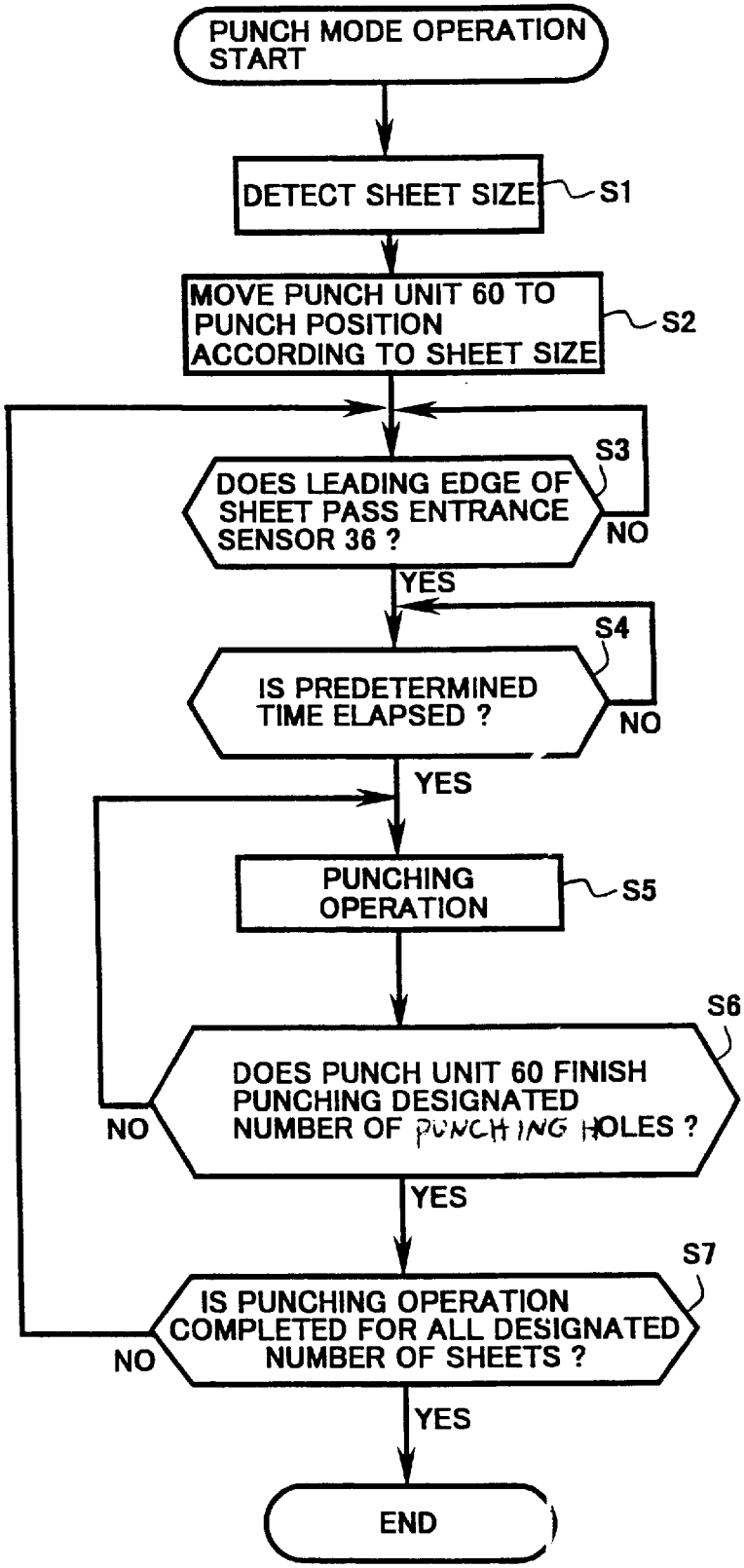
FIG. 9 is a flowchart illustrating steps of a punch mode operation according to the first embodiment of the present invention.

FIG. 9 is a flowchart illustrating steps of a punch mode operation according to the first embodiment of the present invention. After starting the punch mode operation, a sheet size is detected by the sheet size detecting sensor 96 (FIG. 5) in step S1. Next, as described above, the control device 50 controls the move motor 82 such that the punch unit 60 moves to a predetermined punch position according to the sheet size in step S2. In step S3, the control device 50 judges if the leading edge of the sheet P or P' discharged from the discharging rollers 101 is detected by the entrance sensor 36, in other words, if the leading edge of the sheet P or P' passes the entrance sensor 36. If the answer is YES in step S3, the punch mode operation proceeds to step S4. If the answer is NO in step S3, the punch mode operation returns before step S3. In step S4, the control device 50 judges based upon an input from the timer if a predetermined time is elapsed after the entrance sensor 36 detects the leading edge of the sheet P or P'. If the answer is YES in step S4, the leading edge of the sheet P or P' is conveyed to the punch unit 60 by rotations of the entrance rollers 1. If the answer is NO in step S4, the punch mode operation returns before step S4. In step S5, the punch unit 60 performs a punching operation. The punch motor 69 is driven in accordance with the instruction of the control device 50, and thereby the punch member 67 rotates. Particularly, the punch 63 and the die 65 rotate in the directions indicated by the arrows Rb and Ra, respectively, as shown in FIGS. 3 and 8. While the sheet P or P' advances in the sheet conveying path 2R between the punch 63 and the die 65 in the sheet conveying direction X, the punch 63 and the die 65 rotate with each other as illustrated in FIG. 6A.

Figure 6B:
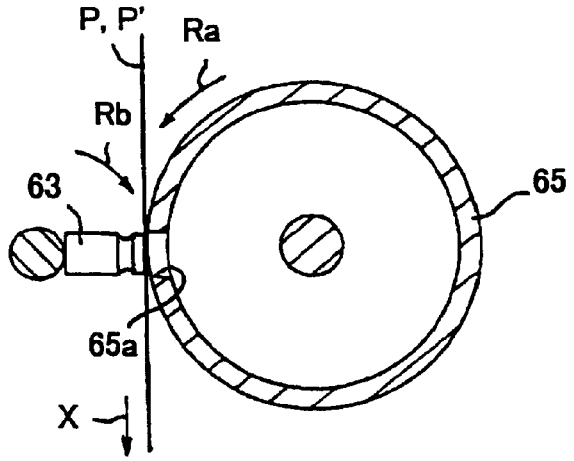
Figure 7A:
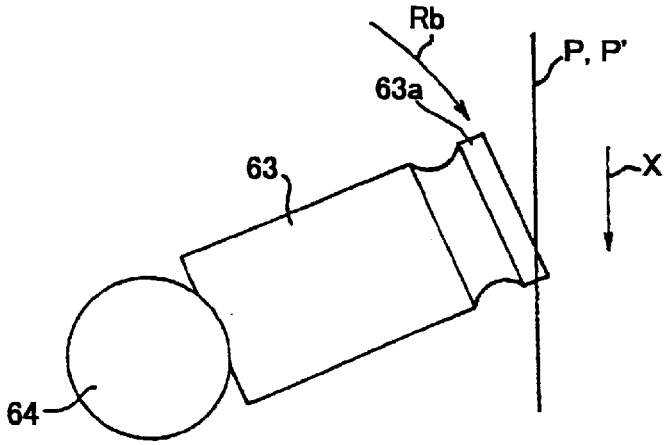
FIG. 7A to FIG. 7C are enlarged detailed elevational views illustrating moving and punching conditions of the punch member of the present invention.
Figure 7B:
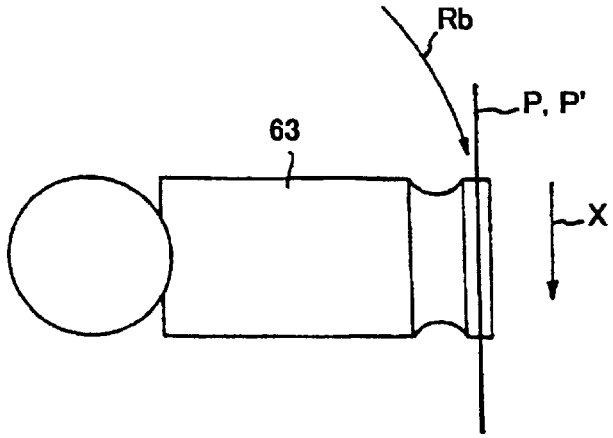
Figure 7C:
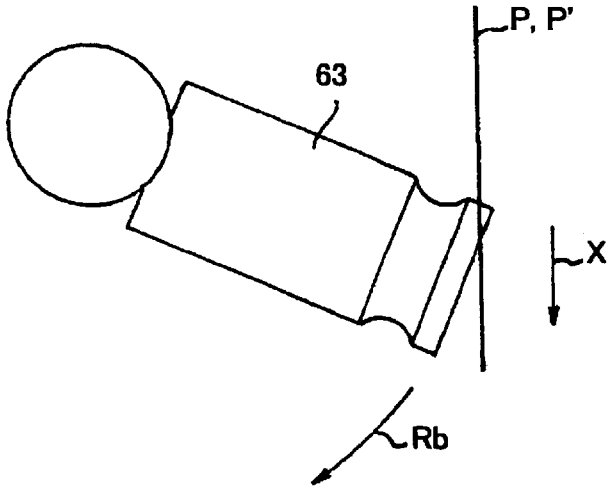

Referring to FIG. 6B, when the hole-shaped blade 65*a* of the die 65 and the punch blade 63*a* of the punch 63 are engaged with each other, a punch hole is punched in the sheet P or P'. FIGS. 7A through 7C are enlarged detail views of a punching operation when a punch hole is punched in the sheet P or P'. As illustrated in FIGS. 7A through 7C, the punch blade 63*a* of the punch 63 quickly pushes and cuts the advancing sheet P or P'.

Figure 6C:
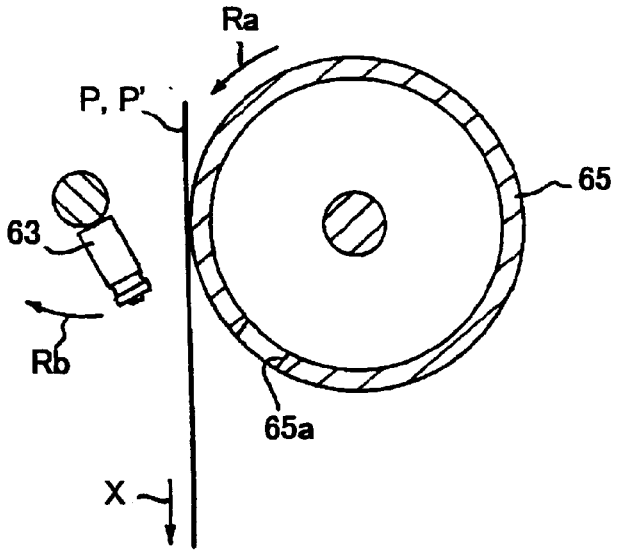

Referring further to FIG. 6C, after a hole is punched in the sheet P or P' in FIG. 6B, the punch 63 and the die 65 rotate further and then stop at their respective home positions. A punch dust which is produced when the punch 63 and the die 65 punch the sheet P or P' falls in the hole-shaped blade 65*a* of the die 65, and further falls through the inside of the die 65 to the container 61*b* of the housing case 61 to be contained therein.

The number of holes, which are punched in the sheet P or P' in the sheet conveying direction X, is preset with the punch hole number selection keys 43*a,* 43*b,* 43*c,* and 43*d.* The control device 50 controls the punching position of holes from the leading edge of the sheet according to a preset number of holes punched in the sheet conveying direction X. Specifically, the control device 50 controls a time between when the leading edge of the sheet P or P' passes the entrance sensor 36 and when the punch motor 69 starts to drive and rotate. That is, the punch 63 and die 65 start to rotate, by calculating the transfer speed of the sheet P or P' and the distance from the leading edge of the sheet P or P' to each hole. In this control process for the punch hole positions, the control device 50 may control the time between when the leading edge of the sheet P or P' passes the entrance sensor 36 and when the punch motor 69 starts to drive and rotate. That is, the punch 63 and die 65 start to rotate easily, because both the driving device (not shown), which rotates the entrance rollers 1, and the punch motor 69 include stepping motors, respectively, and the control device 50 controls the time simply by counting the number of driving pulses of respective stepping motors.

Referring to FIG. 8, the reference character P designates a large size sheet, and the reference character P' designates a small size sheet whose right side edge is illustrated by an imaginary line. FIG. 8 illustrates the condition in which the punch member 67 including the punch 63 and die 65 moves in the sheet width direction Y according to a sheet size. That is, as the sheet size changes from the large size sheet P to the small size sheet P', the punch member 67 moves to the position corresponding to the small size sheet P' in the sheet width direction Y. The moved punch member 67 and the punch holes (Pa) in the sheet P' are illustrated by imaginary lines.

Referring back to FIG. 9, in step S6, the control device 50 judges if the punch unit 60 finishes punching the designated number of punch holes (selected out of two to five holes). If the answer is YES in step S6, the punch mode operation proceeds to step S7. If the answer is NO in step S6, the punch mode operation returns before step S5 and the above-described punching operation is performed. The sheet P or P' in which holes are punched is selectively directed toward the sheet discharging tray 12, the proof tray 14, or the staple unit 11 by the separation guide picks 8*a* and/or 8*b,* respectively. The sheet P or P' directed to the staple unit 11 is discharged finally to the sheet discharging tray 12 after passing through the staple device 15.

In step S7, the control device 50 judges if the punching operation is completed for all of the designated number of sheets P and P'. If the answer is YES in step S7, the punch mode operation ends. If the answer is NO in step S7, a series of the operation steps from step S3 to step S7 are repeatedly performed until the punching operation is completed for all the designated number of sheets P and P'.

In the above-described step S2 of the punch mode operation, the control device 50 controls the move motor 82 based on each signal from the sheet size detecting sensor 96, the home position sensor 94, and the moving amount detecting sensor 93 such that the punch unit 60 stops moving after the punch unit 60 moves to a predetermined punch position according to a sheet size. However, it may be possible that the control device 50 controls the move motor 82 based on a signal from the sheet selection keys group 45, instead of a signal from the sheet size detecting sensor 96, and signals from the home position sensor 94 and the moving amount detecting sensor 93 in step S2.

A second embodiment of the present invention is described referring to FIGS. 10 through 14. The sheet punch device of the second embodiment includes a punch unit 300 in addition to the punch unit 60, an operation panel 39A (see FIGS. 4A and 13) including the punch hole selection key 42 in addition to the punch hole selection keys group 41, 43*a,* 43*b,* 43*c,* and 43*d,* and a control device 50A which controls each punching operation of the punch units 60 and 300.

Figure 10:
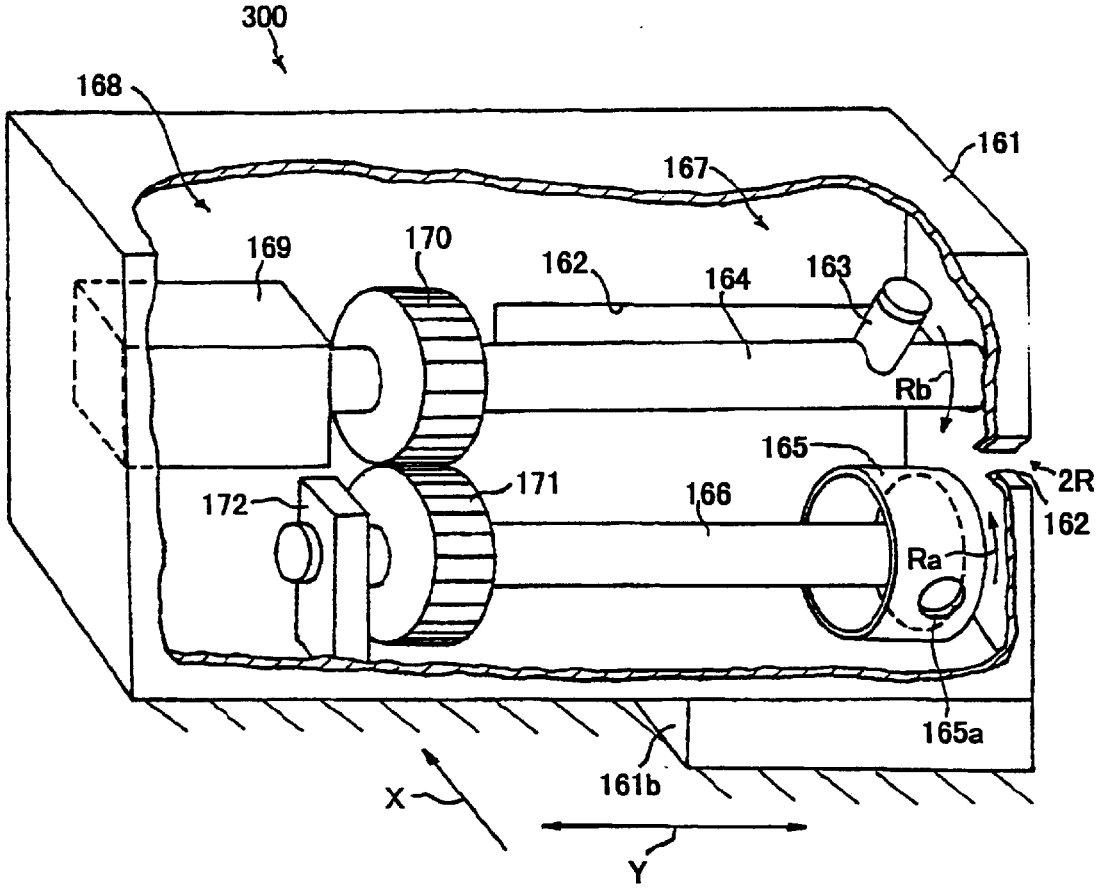
FIG. 10 is a partial broken perspective view illustrating another punch unit according to a second embodiment of the present invention.
Figure 11:
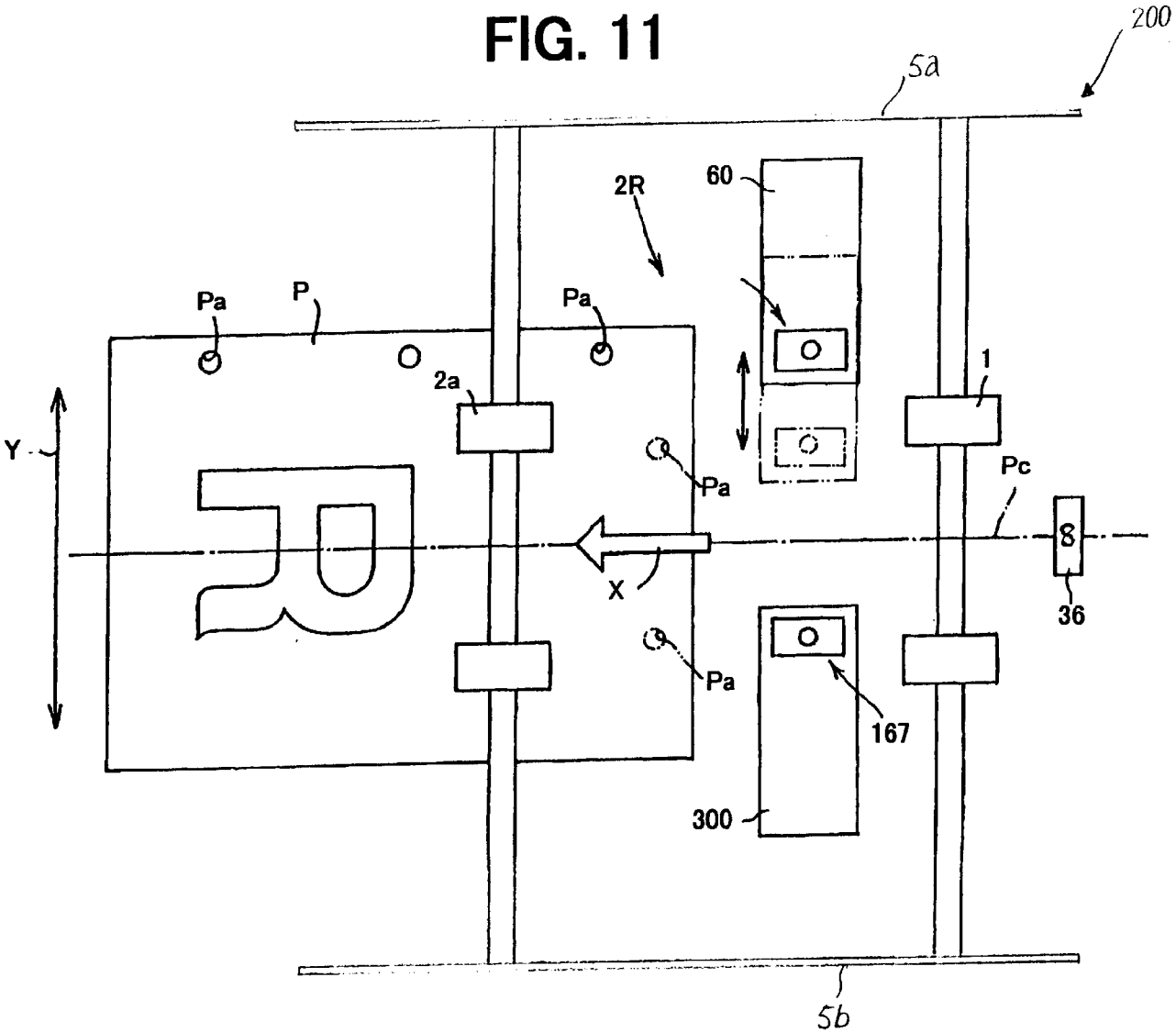
FIG. 11 is a top plane view illustrating surrounding parts of the punch unit according to the second embodiment of the present invention.
Figure 12:
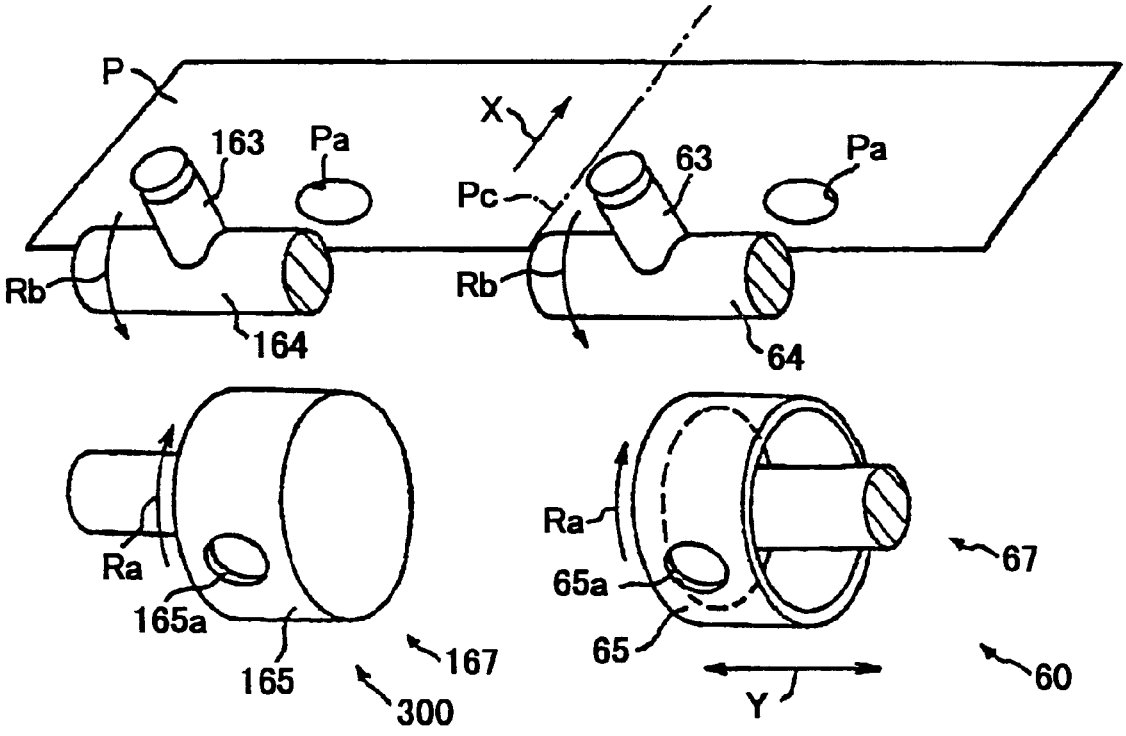
FIG. 12 is a perspective view illustrating a moving and punching condition of punches and dies of two punch members, according to the second embodiment of the present invention.

As illustrated in FIGS. 11 and 12, the punch unit 300 is fixed on the above-described fixed member (not shown) at a predetermined distance from the center position Pc in the sheet width direction Y. As illustrated in FIG. 10, the configuration of the punch unit 300 is substantially symmetrical to that of the punch unit 60, but does not include the moving mechanism 80 included in the punch unit 60. Each element of the punch unit 300 has a reference numeral determined by adding 100 to the corresponding reference numeral of the elements of the punch unit 60. Specifically, the punch unit 300 includes a punch member 167, which is provided at a predetermined distance from the punch member 67 in the sheet width direction Y as illustrated in FIG. 11. The punch member 167 includes a rotatable punch 163 and die 165 which are driven by a punch motor 169 to rotate and punch a sheet. In order to avoid redundancies, further explanation of the configuration of the punch unit 300 is omitted.

When the punch hole selection key 42 of the operation panel 39A is pushed, the display thereof is reversed, and a punching operation for punching holes in the sheet width direction Y becomes ready. The punch hole selection key 42 functions as a second punch hole information setting device to set information for punching punch holes in a sheet in the sheet width direction Y.

Figure 13:
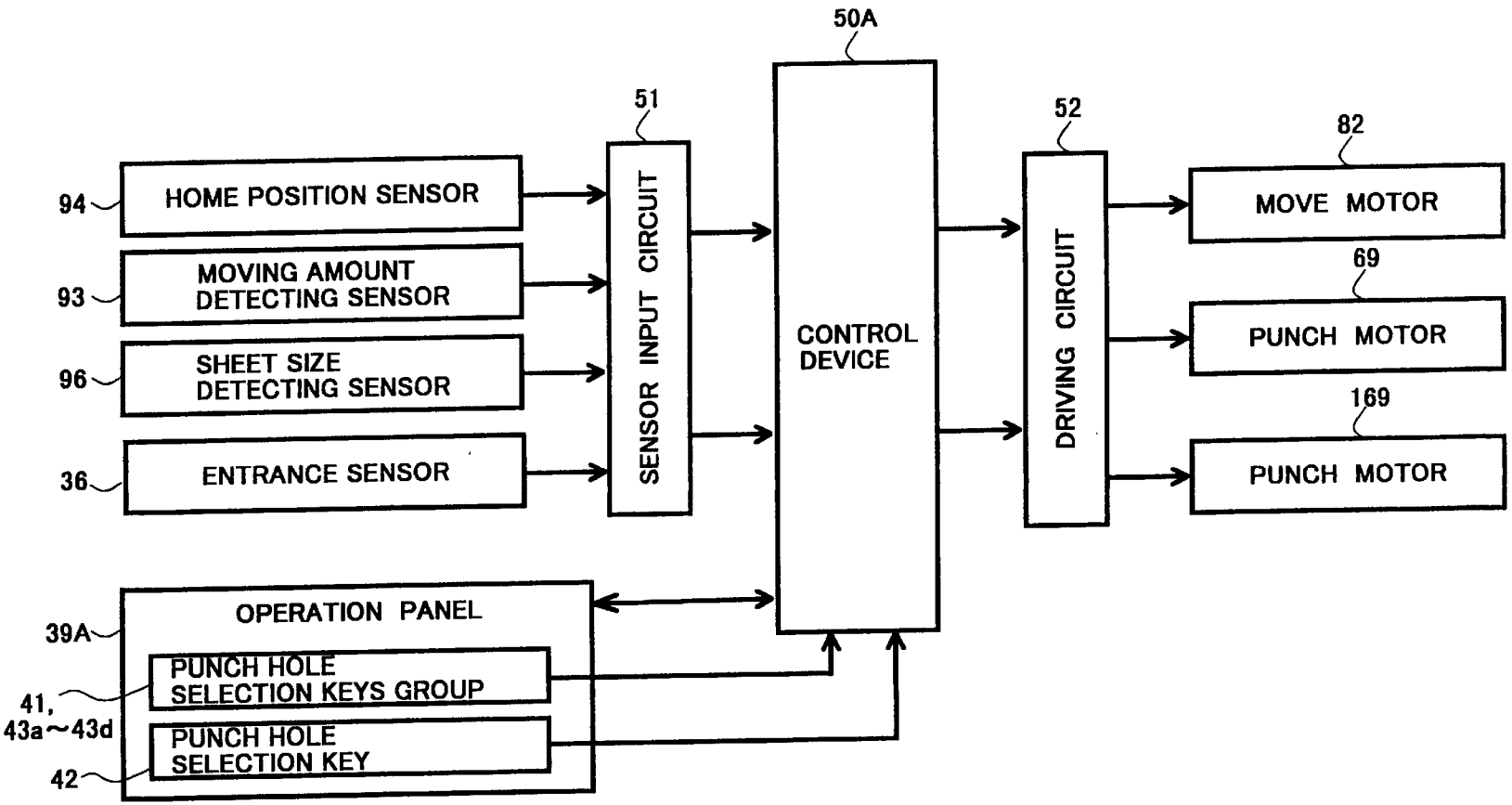
FIG. 13 is a block diagram illustrating a configuration of a control part of a sheet punch device including the punch unit of the second embodiment of the present invention.

FIG. 13 is a block diagram illustrating a configuration of a control part of the sheet punch device according to the second embodiment of the present invention. In the control part according to the second embodiment, an output signal from the punch hole selection key 42 of the operation panel 39A is input to a CPU (not shown) of the control device 50A. Further, the control device 50A sends instriction signals to the punch motor 169 via the driving circuit 52 based on the signals input from the punch hole selection key 42.

Specifically, in addition to each control function of the control device 50 of the first embodiment, the control device 50A judges if the punching operations for punching holes in the sheet conveying direction X described in the first embodiment or for punching holes in the sheet width direction Y should be performed based on either output signal from the punch hole selection keys group 41, 43*a*, 43*b*, 43*c*, and 43*d* or from the punch hole selection key 42. Moreover, the control device 50A controls the move motor 82, the punch motor 69, and the punch motor 169, respectively, such that the punch member 67 and the punch member 167 punch holes in the sheet P at two places in the sheet width direction Y in accordance with the output signals from the punch hole selection key 42.

The punch mode operation of the sheet punch device of the second embodiment of the present invention is now described concentrating on the differences from the first embodiment.

As illustrated in FIG. 11, the aforementioned center standard sheet conveying method is also applied in the second embodiment. In this method, the conveyed sheet P is aligned with a center position Pc in the sheet width direction Y regardless of a sheet size as described earlier.

Figure 14:
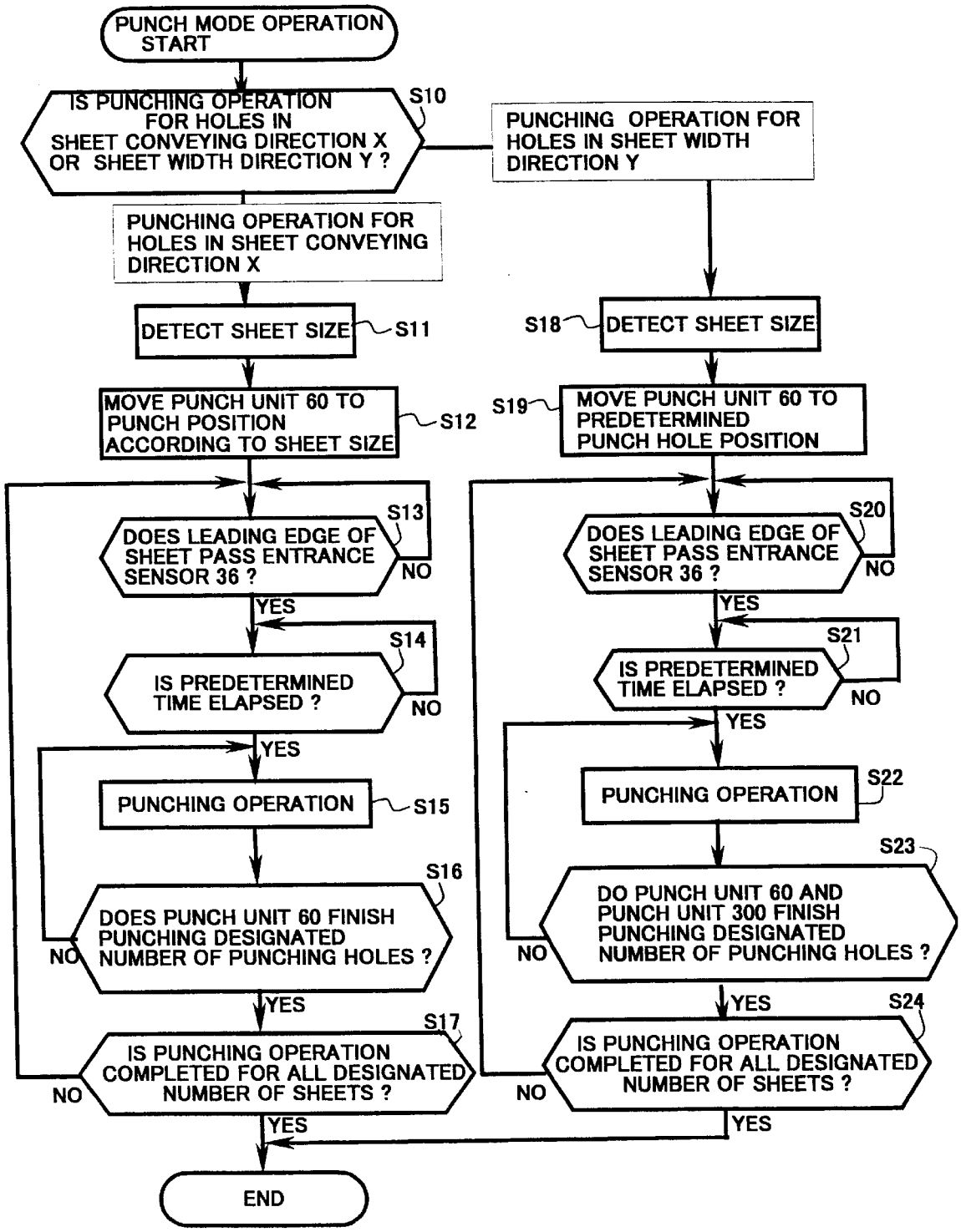
FIG. 14 is a flowchart illustrating steps of a punch mode operation according to the second embodiment of the present invention.

FIG. 14 is a flowchart illustrating steps of a punch mode operation of the second embodiment. After starting the punch mode operation, the control device 50A judges if either a punching operation for punch holes aligned in the sheet conveying direction X or punch holes aligned in the sheet width direction Y should be performed. That is, the control device 50A judges if either the punch hole selection keys group 41, 43*a*, 43*b*, 43*c*, and 43*d* or the punch hole selection key 42 of the operation panel 39A is pushed. If the punch hole selection keys group 41, 43*a*, 43*b*, 43*c*, and 43*d* is pushed, a series of operations for punching holes in the sheet conveying direction X are performed in step S11 through step S17. However, in order to avoid redundancy, the description for operations in step S11 through step S17 is omitted, because they are similar to the aforementioned operations in step S1 through step S7 in FIG. 9 of the first embodiment.

On the other hand, if the punch hole selection key 42 of the operation panel 39A is pushed in step S10, a series of operations for punching holes in the sheet width direction Y are performed in step S18 through step S24. When the punch hole selection key 42 is pushed, the display thereof is reversed, and a punching operation for punching holes in the sheet width direction Y becomes ready in step S10. After step S10, a sheet size is detected by the sheet size detecting sensor 96, and an output signal related to the sheet size information is input to the control device 50A instep S18. Next instep S19, the control device 50A controls the punch unit 60 to move to a predetermined punch hole position in the sheet width direction Y based on each signal from the sheet size detecting sensor 96, the home position sensor 94, and the moving amount detecting sensor 93, and then stops.

In step S20, the control device 50A judges if the leading edge of a sheet P (FIGS. 11 and 12) discharged from the discharging rollers 101 is detected by the entrance sensor 36, in other words, if the leading edge of the sheet P passes the entrance sensor 36. If the answer is YES in step S20, the punch mode operation proceeds to step S21. If the answer is NO in step S20, the punch mode operation step returns before step S20. In step S21, the control device 50A judges based on an input from the timer if a predetermined time has elapsed after the entrance sensor 36 detects the leading edge of the sheet P. If the answer is YES in step S21, the leading edge of the sheet P is conveyed to the punch unit 60 and the punch unit 300 by rotations of the entrance rollers 1. If the answer is NO in step S21, the punch mode operation returns before step S21.

In step S22, a punching operation characteristic of the second embodiment of the present invention is performed, in which the punch unit 60 and the punch unit 300 operate simultaneously. Specifically, the punch motor 69 and the punch motor 169 are simultaneously driven in accordance with the instructions of the control device 50A, and thereby the punch member 67 and the punch member 167 rotate, respectively. As illustrated in FIG. 12, the punch 63 and die 65 of the punch member 67, and the punch 163 and die 165 of the punch member 167 rotate, respectively, and then punch holes (Pa) at two different places near the trailing edge of the sheet P symmetrically with respect to the center position Pc (FIGS. 11 and 12) of the sheet P in the sheet width direction Y. The description of the detailed punching operation of the punch 163 and die 165 is omitted, because it is similar to the punching operation of the punch 63 and die 65 of the punch member 67 described in step S5 in FIG. 9.

Next, in step S23, the control device 50A judges if the punch unit 60 and the punch unit 300 finish the designated operation for punching two holes in the sheet width direction Y. If the answer is YES in step S23, the punch mode operation proceeds to step S24. If the answer is NO in step S23, the punch mode operation returns before step S24 and the above-described punching operation is performed. The sheet P in which holes are punched is selectively directed toward the sheet discharging tray 12, the proof tray 14, or the staple unit 11 by the separation guide picks 8*a* and/or 8*b*. The sheet P directed to the staple unit 11 is discharged finally to the sheet discharging tray 12 after passing through the staple device 15.

In step S24, the control device 50A judges if the punching operation has completed for all of the designated number of sheets P. If the answer is YES in step S24, the punch mode operation ends. If the answer is NO in step S24, a series of punch mode operations from step S20 to step S24 are repeatedly performed until the punching operation is completed for all the designated number of sheets P.

In the second embodiment of the present invention, the holes are punched at two different places near the trailing edge of the sheet P symmetrically with respect to the center position Pc of the sheet P in the sheet width direction Y. Alternatively, the above holes may be punched at two places near the leading edge of the sheet P symmetrically with respect to the center position Pc of the sheet P in the sheet width direction Y.

Moreover, though the punch unit 300 is fixed in the second embodiment, the punch unit 300 may have a similar moving mechanism as that of the punch unit 60 to move in the sheet width direction Y such that at least two holes at user's desired positions in the sheet width direction Y are punched in cooperation with the punch unit 60.

Figure 15:
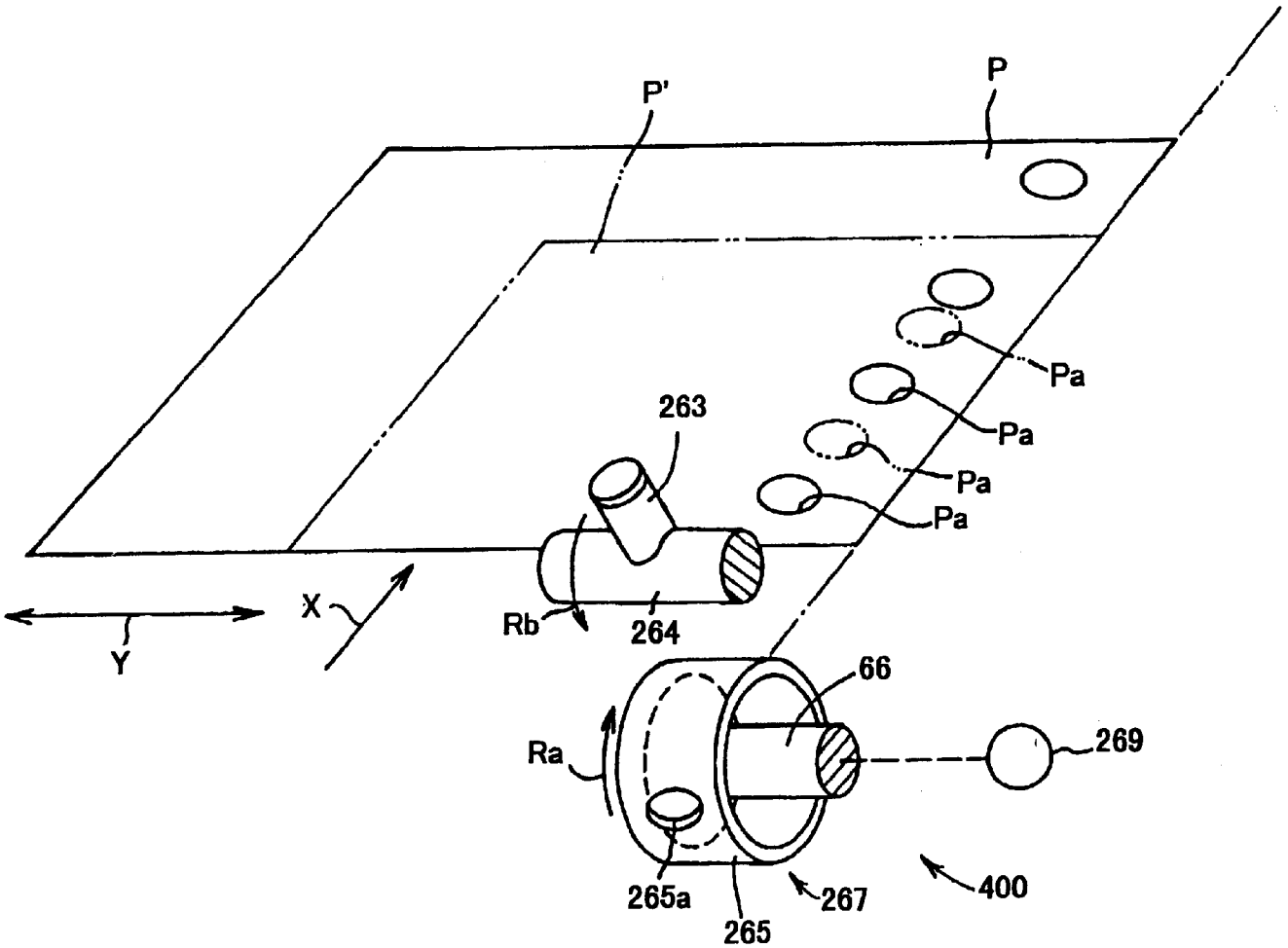
FIG. 15 is a perspective view illustrating a punching condition of a punch and die of a punch member according to the third embodiment of a present invention.

The third embodiment is described referring to FIG. 15. A sheet punch device in the third embodiment includes a punch unit 400 instead of the punch unit 60 of the first embodiment. The elements of the control part of the third embodiment are substantially the same as those illustrated in FIG. 5, except the home position sensor 94, the moving amount detecting sensor 93. and the move motor 82.

The punch unit 400 is fixed on the above-described fixed member such that holes (Pa) are punched at positions at the predetermined distance from the side edge of a sheet P or P' as illustrated in FIG. 15. In the third embodiment, the conveyed sheet P or P' is aligned such that one side edge of the sheet in the sheet conveying direction X is in the same position regardless of sheet size (a side edge standard sheet conveying method). The configuration of the punch unit 400 is substantially symmetrical to that of the punch unit 300 and is substantially the same as that of the punch unit 60 except the moving mechanism 80. In order to avoid redundancy, each element of the punch unit 400 has a reference numeral determined by adding 200 to the corresponding reference numeral of the elements of the punch unit 60, and therefore a further explanation is omitted.

A control device (not shown) of the third embodiment controls a punch motor 269, which is illustrated in FIG. 15, by sending instruction signals thereto via the driving circuit 52 based on signals input to the control device. Specifically, the control device controls the punch motor 269 to drive the punch member 267 such that a predetermined number of holes are punched at predetermined positions in the sheet conveying direction X based on each signal from the punch hole selection keys group 41, 43*a*, 43*b*, 43*c*, and 43*d*, a predetermined time after the entrance sensor 36 detects a leading edge of the sheet. In a ROM of the above control device, a program and data are stored to control the punch motor 269 as above.

The punch mode operation of the third embodiment is substantially the same as those of the first embodiment in FIG. 9 except the operation in step S2. The detailed description of the punch mode operation of the third embodiment is therefore omitted.

The moving mechanism of the sheet punch device of the first and second embodiments is not limited to the moving mechanism 80, but other mechanisms may be applicable, such as (1) a wire type moving mechanism including a wire, a wire pulley, a guide/support rail, and a wire pulley drive motor, and (2) a belt type moving mechanism including a timing belt, a belt pulley, a guide/support rail, and a belt pulley drive motor.

The drive motor of the sheet punch device of the first, second, and third embodiments to drive and rotate each punch member 67, 167, and 267 is not limited to the punch motor 69, 169, and 269 using a stepping motor, but other control drive motors using, for example, a DC motor, may be applicable, if the above-described merits of the stepping motor are not necessary.

In the sheet punch device of the first and third embodiments, positions of the punch holes in a sheet in the sheet conveying direction X are determined according to a sheet size based on the signal from the sheet size detecting sensor 96. Moreover, punch hole positions may be set by an operator via manipulation of an operation panel. For example, the operation panel may include a moving amount setting key to set a moving amount of a punch unit, and a display device to display the moving amount of the punch unit, which is set with the moving amount setting key, so as to be visually recognized. The operator can set a desired number of punch holes at desired places in a sheet by using the above moving amount setting key and the display device.

As described above, the punch motors 69, 169, and 269 which drive and rotate the punch 63 and die 65, the punch 163 and die 165, and the punch 263 and die 265, respectively, are separate from a sheet conveying motor. Owing to this configuration of the driving mechanism, the sheet punch device of the present invention can precisely punch a hole at a predetermined position in a sheet without deviating the punch hole from the predetermined position.

Obviously, numerous additional modifications and variations of the present invention are possible in light of the above teachings. It is therefore to be understood that within the scope of the appended claims, the present invention may be practiced otherwise than as specifically described herein.

This document is based on Japanese Patent Application No. 10-209157 filed in the Japanese Patent Office on Jul. 24, 1998, and on Japanese Patent Application No. 11-152110 filed in the Japanese Patent Office on May 31, 1999, the entire contents of which are hereby incorporated by reference.

What is claimed is:

1. A sheet punch device, comprising:

a first punch member including a rotatable punch and die pair configured to punch a hole in a sheet;

a first driving member configured to drive and rotate the first punch member to punch a hole in a conveyed sheet;

a moving/driving device configured to move the first punch member in a direction perpendicular to a sheet conveying direction;

a second punch member including a rotatable punch and die pair configured to punch a hole in a sheet, and being positioned a predetermined distance from the first punch member in a direction perpendicular to the sheet conveying direction;

a second driving member configured to drive and rotate the second punch member to punch a hole in the conveyed sheet;

a first punch hole information setting device configured to set punch hole information for punching holes in the conveved sheet at plural places aligned in the sheet conveying direction; and a second punch hole information setting device configured to set punch hole information for punching holes in the conveyed sheet at plural places aligned in a direction perpendicular to the sheet conveying direction, wherein the sheet punch device punches holes in the conveyed sheet based on signals from one of the first punch hole information setting device and the second punch hole information setting device;

wherein the moving/driving device moves the first punch member to a predetermined distance from an edge of the conveyed sheet so the first punch member punches holes in the conveyed sheet at plural places aligned in the sheet conveying direction when a request is made to punch holes in the conveyed sheet at plural places aligned in the sheet conveying direction via the first punch hole information setting device, and wherein the moving/driving device moves the first punch member to a predetermined distance from the second punch member so the first punch member operates in unison with the second punch member to simultaneously punch holes in the sheet at least at two places in the direction perpendicular to the sheet conveying direction when a request is made to punch holes in the conveyed sheet at plural places aligned in the direction perpendicular to the sheet conveying direction via the second punch hole information setting device.

2. The sheet punch device according to claim 1, further comprising:

a sheet detecting member that is disposed upstream of the first punch member in the sheet conveying direction and that detects a leading edge of the sheet being conveyed; and a control device configured to control the first driving member such that the first punch member punches a predetermined number of holes in the conveyed sheet sequentially at predetermined positions aligned in the sheet conveying direction and at a predetermined time after the sheet detecting member detects a leading edge of the conveyed sheet.

3. The sheet punch device according to claim 2, wherein the control device controls the first driving member according to a size of the conveyed sheet.

4. The sheet punch device according to claim 3, wherein the control device controls the first driving member according to a size of the conveyed sheet and based on signals from the first punch hole information setting device.

5. The sheet punch device according to claim 2, wherein the control device controls the first driving member based on signals from the first punch hole information setting device.

6. The sheet punch device according to claim 2, wherein the control device controls the moving/driving device such that the first punch member stops moving when the first punch member reaches a position at a predetermined distance apart from a side edge of a sheet at a side of the first punch member in the direction perpendicular to the sheet conveying direction, and controls the first driving member such that the first punch member punches the predetermined number of holes in the conveyed sheet sequentially at the predetermined positions aligned in the sheet conveying direction, based on signals from the first punch hole information setting device.

7. The sheet punch device according to claim 2, wherein the control device controls the moving/driving device such that the first punch member stops moving when the first punch member reaches a position at a predetermined distance apart from a side edge of a sheet at a side of the first punch member in the direction perpendicular to the sheet conveying direction, and controls the first driving member such that the first punch member punches the predetermined number of holes in the conveyed sheet sequentially at the predetermined positions aligned in the sheet conveying direction, according to a size of the conveyed sheet.

8. The sheet punch device according to claim 7, wherein the control device controls the moving/driving device such that the first punch member stops moving when the first punch member reaches a position at a predetermined distance apart from a side edge of a sheet at a side of the first punch member in the direction perpendicular to the sheet conveying direction, and controls the first driving member such that the first punch member punches the predetermined number of holes in the conveyed sheet sequentially at the predetermined positions aligned in the sheet conveying direction, according to a size of the conveyed sheet and based on signals from the first punch hole information setting device.

9. The sheet punch device according to claim 1, wherein the second punch member is fixed.

10. A sheet punch device, comprising:

first means for punching a hole in a sheet, the first punching means including a rotatable punch and a die pair;

first means for driving and rotating the first punching means to punch a hole in a conveyed sheet;

means for moving the first punching means in a direction perpendicular to a sheet conveying direction;

second means for punching a hole in a sheet the second punching means including a rotatable punch and die pair and being positioned a predetermined distance from the first punching means in a direction perpendicular to the sheet conveying direction;

second means for driving and rotating the second punching means to punch a hole in the conveyed sheet;

first means for setting punch hole information for punching holes in the conveyed sheet at plural places aligned in the sheet conveying direction; and second means for setting punch hole information for punching holes in the conveyed sheet at plural places aligned in a direction perpendicular to the sheet conveying direction, wherein the sheet punch device punches holes in the conveyed sheet based on signals from one of the first punch hole information setting means and the second punch hole information setting means, wherein the moving means moves the first punching means to a predetermined distance from an edge of the conveyed sheet so the first punching means punches holes in the conveyed sheet at plural places aligned in the sheet conveying direction when a request is made to punch holes in the conveyed sheet at plural places aligned in the sheet conveying direction via the first punch hole information setting means, and wherein the moving means moves the first punching means to a predetermined distance from the second punching means so the first punching means operates in unison with the second punching means to simultaneously punch holes in the sheet at least at two places in the direction perpendicular to the sheet conveying direction when a request is made to punch holes in the conveyed sheet at plural places aligned in a direction perpendicular to the sheet conveying direction via the second punch hole information setting means.

11. The sheet punch device according to claim 10, wherein the second punching means is fixed.

12. The sheet punch device according to claim 10, further comprising:

means for detecting a leading edge of the sheet being conveyed, the detecting means being disposed upstream of the first punching means in the sheet conveying direction; and means for controlling the first driving means such that the first punching means punches a predetermined number of holes in the conveyed sheet sequentially at predetermined positions aligned in the sheet conveying direction and at a predetermined time after the detecting means detects a leading edge of the conveyed sheet.

13. The sheet punch device according to claim 12, wherein the control means controls the moving means such that the first punching means stops moving when the first punching means reaches a position at a predetermined distance apart from a side edge of a sheet at a side of the first punching means in the direction perpendicular to the sheet conveying direction, and controls the first driving means such that the first punching means punches the predetermined number of holes in the conveyed sheet sequentially at the predetermined positions aligned in the sheet conveying direction, according to a size of the conveyed sheet.

14. The sheet punch device according to claim 13, wherein the control means controls the moving means such that the punching means stops moving when the punching means reaches a position at a predetermined distance apart from a side edge of a sheet at a side of the first punching means in the direction perpendicular to the sheet conveying direction, and controls the first driving means such that the punching means punches the predetermined number of holes in the conveyed sheet sequentially at the predetermined positions aligned in the sheet conveying direction, according to a size of the conveyed sheet and based on signals from the first punch hole information setting means.

15. The sheet punch device according to claim 12, wherein the control means controls the first driving means according to a size of the conveyed sheet.

16. The sheet punch device according to claim 15, wherein the control means controls the first driving means according to a size of the conveyed sheet and based on signals from the first punch hole information setting means.

17. The sheet punch device according to claim 12, wherein the control means controls the first driving means based on signals from the first punch hole information setting means.

18. The sheet punch device according to claim 12, wherein the control means controls the moving means such that the first punching means stops moving when the first punching means reaches a position at a side edge of a sheet at a side of the first punching means in the direction perpendicular to the sheet conveying direction, and controls the first driving means such that the first punching means punches the predetermined number of holes in the conveyed sheet sequentially at the predetermined positions aligned in the sheet conveying direction, based on signals from the first punch hole information setting means.

* * * * *